US010542783B2

(12) United States Patent
Winner

(10) Patent No.: US 10,542,783 B2
(45) Date of Patent: Jan. 28, 2020

(54) ADAPTABLE PROTECTIVE GARMENT

(71) Applicant: Carol Winner, Mission Hills, KS (US)

(72) Inventor: Carol Winner, Mission Hills, KS (US)

( * ) Notice: Subject to any disclaimer, the term of this patent is extended or adjusted under 35 U.S.C. 154(b) by 339 days.

(21) Appl. No.: 15/370,396

(22) Filed: Dec. 6, 2016

(65) Prior Publication Data

US 2017/0156415 A1 Jun. 8, 2017

Related U.S. Application Data

(60) Provisional application No. 62/264,079, filed on Dec. 7, 2015.

(51) Int. Cl.

| | |
|---|---|
| ***A41D 13/00*** | (2006.01) |
| ***A41D 1/04*** | (2006.01) |
| ***A41D 13/12*** | (2006.01) |
| *A41D 13/05* | (2006.01) |

(52) U.S. Cl.

CPC ..... *A41D 13/1245* (2013.01); *A41D 13/0518* (2013.01); *A41D 2400/32* (2013.01)

(58) Field of Classification Search

CPC ..... A41D 13/1245; A41D 13/0575; A41D 13/0518; A41D 2400/32

See application file for complete search history.

(56) References Cited

U.S. PATENT DOCUMENTS 1,272,427 A * 7/1918 Haderlein ..... A61F 13/145 450/37
5,257,956 A * 11/1993 Ewen ..... A41C 3/148 2/102
6,155,263 A * 12/2000 Weaver ..... A41D 13/08 128/878
6,681,404 B1 1/2004 Adlard et al.
7,396,272 B1 * 7/2008 Newlen ..... A41D 13/1245 2/114
2002/0103452 A1 * 8/2002 Lloyd ..... A61F 15/004 602/60
2005/0144704 A1 7/2005 Vitallo
2010/0205720 A1 8/2010 Ortega Astor
2011/0067169 A1 3/2011 Compton et al.
2012/0311755 A1 12/2012 Neuron
2013/0227764 A1 9/2013 DiDavide

FOREIGN PATENT DOCUMENTS

GB 144043 6/1920

OTHER PUBLICATIONS

International Search Report and Written Opinion from PCT/US2016/065306 (Search Report and Written Opinion dated Feb. 16, 2017).

* cited by examiner

*Primary Examiner* — Anna K Kinsaul
(74) *Attorney, Agent, or Firm* — Hovey Williams LLP

(57) ABSTRACT

An adaptable protective garment is configured to be donned by a user to cover and identify a sensitive portion of the user. The adaptable protective garment broadly includes an outer garment layer, an inner garment layer, and exposed indicia. The outer garment layer covers the sensitive portion when the garment is donned. At least one of the garment layers defines an interior pocket that is covered by the outer garment layer when the garment is donned so as to be hidden from view. The exposed indicia is secured to the exterior surface of the outer garment layer and is viewable when the garment is donned. The exposed indicia is located adjacent the interior pocket to visibly identify the location of the interior pocket along the exterior surface.

20 Claims, 19 Drawing Sheets

ADAPTABLE PROTECTIVE GARMENT

RELATED APPLICATION

This application claims the benefit of U.S. Provisional Application Ser. No. 62/264,079, filed Dec. 7, 2015, entitled ADAPTABLE COMFORT GARMENT, which is hereby incorporated in its entirety by reference herein.

BACKGROUND

1. Field

The present invention relates generally to protective and supportive garments. More specifically, embodiments of the present invention concern an adaptable protective garment with exposed indicia.

2. Discussion of Prior Art

Medical professionals recognize that the short-term aftermath of surgical procedures can be a stressful time for a patient. The patient can have emotional issues that develop as a result of a surgery, such as a mastectomy. Such emotional issues may be due to insecurity related to a physical change or fear of infection. The desire of friends and family to attempt to comfort the patient by hugging or kissing is natural, yet the physical interaction can be discomforting, stressful, and can physically put the patient at risk. For instance, physical interaction can cause trauma to the surgical site. Interactions can also compromise patients through the transmission of germs, particularly in patients who are immunologically suppressed and have a high risk of infection from exposure to others, such as those treated with bone marrow replacement or chemotherapy.

Often post-operative patients report fear of returning to their social life for various reasons, but fear of physical interaction is often reported as a factor that repels them from engaging with others. A person's fear of exposure to a virus by a kiss, such as influenza or infectious disease or of someone in the grocery store recognizing them, thus touching them physically, is of real and legitimate concern. Researchers of special needs or condition populations have found that among those with Autism, minimizing social interaction with others results in less stress for the individual. Behavioral health professionals recognize that getting too close to a person can also result in an increase in stress level, as reported particularly among psychiatric patients, resulting in compromised health.

Conventional medical garments have various deficiencies. For instance, known garments provide inadequate protection and support for post-operative patients against the harmful types of contact described above. In particular, conventional garments fail to provide protection and support for patients who have had a mastectomy or other upper torso surgery. Prior art garments are also known to provide inadequate protection and support for mental health patients (e.g., patients with Autism, anxiety, obsessive compulsive disorder (OCD), or post-traumatic stress disorder (PTSD)) and patients with other physically sensitive conditions.

SUMMARY

The following brief summary is provided to indicate the nature of the subject matter disclosed herein. While certain aspects of the present invention are described below, the summary is not intended to limit the scope of the present invention.

Embodiments of the present invention provide an adaptable protective garment that does not suffer from the problems and limitations of the prior art garments set forth above.

A first aspect of the present invention concerns an adaptable protective garment configured to be donned by a user to cover and identify a sensitive portion of the user. The adaptable protective garment broadly includes an outer garment layer, an inner garment layer, and exposed indicia. The outer garment layer covers the sensitive portion when the garment is donned. The outer garment layer presents interior and exterior surfaces, with the exterior surface being viewable when the garment is donned. The inner garment layer is fixed relative to the interior surface of the outer garment layer, with the garment layers cooperatively defining a continuous attachment margin along which the layers are fixed relative to one another. At least one of the garment layers defines an interior pocket that is covered by the outer garment layer when the garment is donned so as to be hidden from view, with the attachment margin at least partly surrounding the interior pocket. The exposed indicia is secured to the exterior surface of the outer garment layer and is viewable when the garment is donned. The exposed indicia is located adjacent the interior pocket to visibly identify the location of the interior pocket along the exterior surface.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 1:
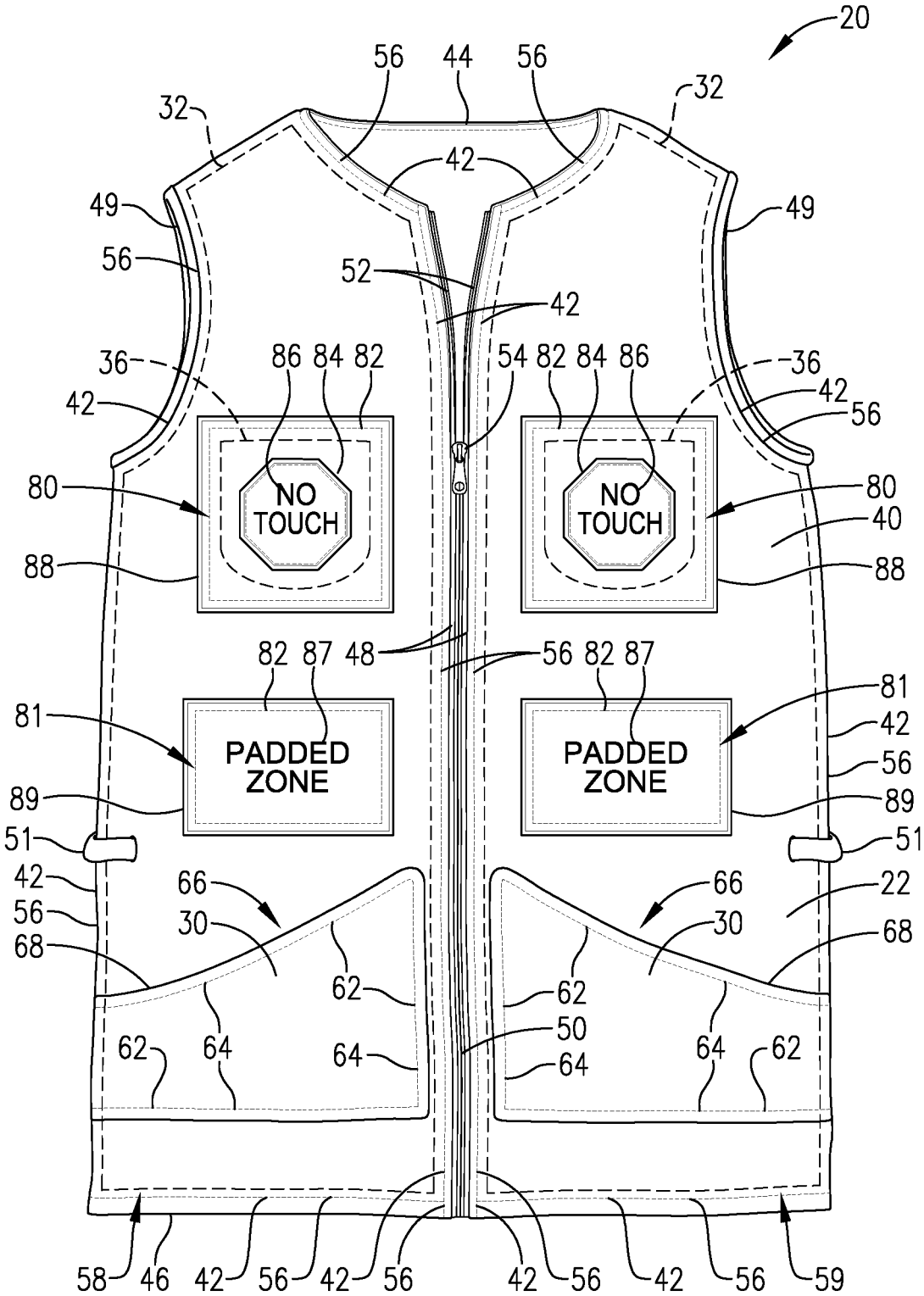
FIG. 1 is a front elevation of an adaptable protective garment constructed in accordance with a first preferred embodiment of the present invention.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1-7, a reusable adaptable protective garment 20 is constructed in accordance with a preferred embodiment of the present invention. The garment 20 is preferably donned by a wearer (not shown) to provide protection and therapeutic comfort to the wearer. Although the illustrated garment 20 is preferably close fitting and snug when donned by the wearer, it will be appreciated that the garment could comprise a compression garment that provides compression to the wearer.

Preferably, the garment 20 can be selectively (and repeatedly) donned and removed by the wearer, as necessary. As will be shown, the garment 20 provides sections that can protect a sensitive portion of the wearer by cushioning the wearer from exterior forces. That is, the construction of the illustrated garment 20 has sections that restrict an exterior force applied to the garment 20 from being transferred to the wearer. The garment 20 is also particularly useful when donned by the wearer to cover and identify the sensitive portion of the wearer to others. Importantly, the garment 20 has features to identify and warn other people of sensitive areas associated with the wearer. In general, the garment 20 preferably comprises durable medical equipment that can be used repeatedly, by one or more post-operative users, to provide therapeutic comfort and protection.

The garment 20 can be used to protect a portion of the wearer that is physically sensitive due to a variety of reasons (e.g., when the wearer has undergone a medical treatment, such as a surgical procedure, and/or has a medical condition, and the associated area is painful and sensitive). For instance, the garment 20 has features that are configured to protect and comfort the torso of a mastectomy patient. For some aspects of the present invention, the garment 20 could also include features to apply compression to the patient's torso. As will be discussed, the cushioning sections of the garment 20 provide the garment 20 with additional cushioning, flexibility, and/or "give." The garment 20 preferably includes an outer layer 22, fill layers 24, an intermediate liner layer 26, inner pocket layers 28, outer pocket layers 30, removable front and back torso pads 32,34, and removable breast pads 36.

The outer layer 22 and the liner layer 26 each preferably comprise a continuous web of resilient sheet material that is shaped to provide corresponding outermost and intermediate layers of the garment 20. The outer layer 22 preferably presents interior and exterior layer surfaces 38,40. The liner layer 26 preferably presents front and back access slits 41*a,b*.

The outer and liner layers 22,26 are shaped and sewn to each other along corresponding seams 42 so that the layers 22,26 are substantially coextensive with one another. When the garment 20 is donned by the wearer, the layers 22,26 are configured to cover a sensitive region of the wearer. The layers 22,26 cooperatively form an upper margin 44, lower margin 46, and upright garment fastening margins 48 of the garment 20 (see FIG. 3). The layers 22,26 also cooperatively form a pair of arm openings 49.

The garment 20 preferably includes a continuous fastener 50 in the form of a zipper to secure the fastening margins 48 to one another (see FIG. 1). The garment 20 also includes a pair of adjustable tabs 51 (see FIG. 1) that each include an adjustable connector (not shown). The tabs 51 are configured to adjust the waist size of the garment 20. The zipper fastener 50 is conventional and preferably includes two (2) rows of zipper teeth 52 and a slider 54. In the usual manner, the rows of zipper teeth 52 are fixed to corresponding ones of the fastening margins 48. The slider 54 is slidable vertically along the rows to move the teeth of each row into and out of engagement with one another. In this manner, the slider 54 is operable to selectively open and close the fastener 50.

However, it is within the ambit of the present invention where an alternative fastener is used to connect the fastening margins 48 to each other. For instance, other conventional fasteners, such as buttons, snaps, or hook-and-loop material could be used in place of the fastener 50.

Figure 3:
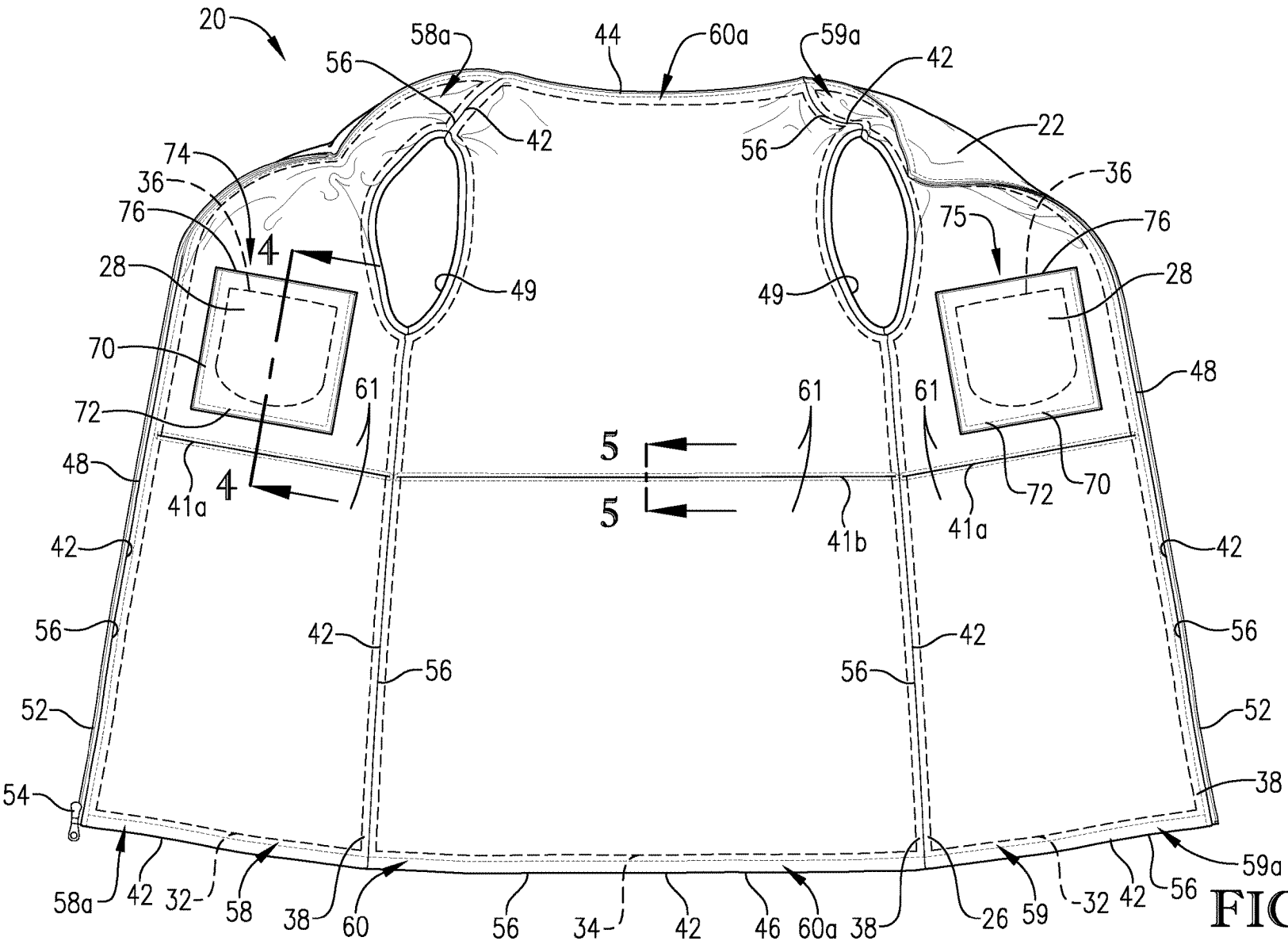
FIG. 3 is a front elevation of the adaptable protective garment similar to FIG. 1, but with the garment being opened to expose the interior of the garment.

The illustrated seams 42 provide continuous attachment margins 56 along which the outer and liner layers 22,26 are fixed to each other to cooperatively form front torso pockets 58,59 and a back torso pocket 60 within the garment 20 (see FIG. 3). The illustrated torso pockets 58,59,60 are elongated and extend vertically along the length of the garment 20 to present corresponding pocket ends 58*a*,59*a*,60*a* (see FIG. 3). The pocket ends 58*a*,59*a*,60*a* are located adjacent to corresponding upper and lower margins 44,46 of the garment 20.

The illustrated seams 42 preferably fix the layers 22,26 to one another. In particular, the seams 42 preferably include a series of stitches that are sewn through both layers 22,26 to permanently fix the layers to one another. That is, the stitches are generally not removable to permit selective attachment and detachment of the layers 22,26.

The stitches are preferably formed by a continuous length of synthetic resin thread material. However, it will be appreciated that the seams 42 could be formed by an alternative layer fastening structure without departing from the scope of the present invention. For instance, at least one of the seams could be formed by a line of adhesive between the layers 22,26 to permanently adhere the layers to one another along the seam. Also, at least one of the seams could include a line of sealant material so that the seam provides a continuous line of sealing engagement between the layers 22,26. Furthermore, at least one of the seams could be formed by a removable fastening structure. Yet further, at least one of the seams could include a combination of fastening mechanisms, including permanent fastening structure and removable fasteners.

The illustrated torso pockets 58,59,60 are preferably separated from one another by corresponding seams 42. However, it is within the scope of the present invention where the layers 22,26 are joined to form a single, uninterrupted, torso pocket. Furthermore, the torso pockets 58,59, 60 could have other alternative configurations.

The illustrated access slits 41*a*,41*b* preferably extend in a lateral direction that is transverse to the length of the garment 20. The access slits 41*a*,41*b* are also preferably spaced between the ends of the corresponding pockets 58,59,60. More preferably, the access slits 41*a*,41*b* are spaced about midway between the ends of the corresponding pockets 58,59,60. However, the access slits 41*a*,41*b* could be alternatively shaped and/or positioned along the length of the pockets 58,59,60 to provide an opening that allows suitable access to the respective pocket 58,59,60.

The illustrated access slits 41*a*,41*b* define pairs of adjacent margins 61 of the liner layer 26 that are detached from each other and are permitted to move to a limited extent relative to one another (see FIG. 3). However, each pair of adjacent margins 61 could be removably connected to one another to selectively close the respective access slit 41 and restrict relative movement between the adjacent margins 61. For instance, conventional fasteners, such as a zipper, button, snap, or hook-and-loop material, could be fixed to the adjacent margins 61 and used to removably connect the adjacent margins 61.

The front access slits 41*a* preferably communicate with respective ones of the front torso pockets 58,59 to permit insertion and removal of corresponding front torso pads 32 relative to the pockets 58,59, as will be discussed. Similarly, the back access slit 41*b* preferably communicates with the rear torso pocket 60 to permit insertion and removal of the back torso pad 34.

Figure 6:
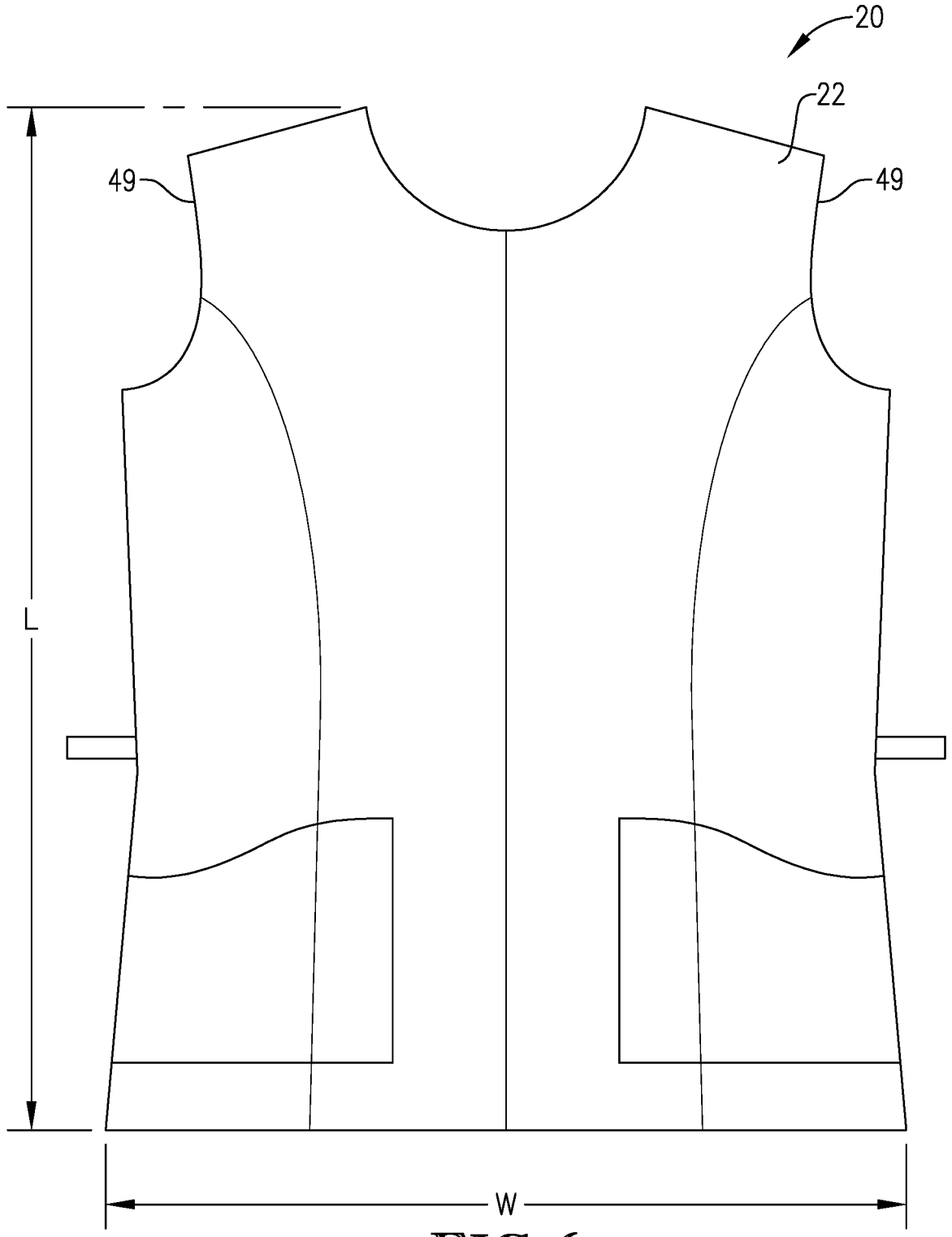
FIG. 6 is a schematic front elevation of the adaptable protective garment shown in FIGS. 1-5, showing various dimensions of the garment.
Figure 7:
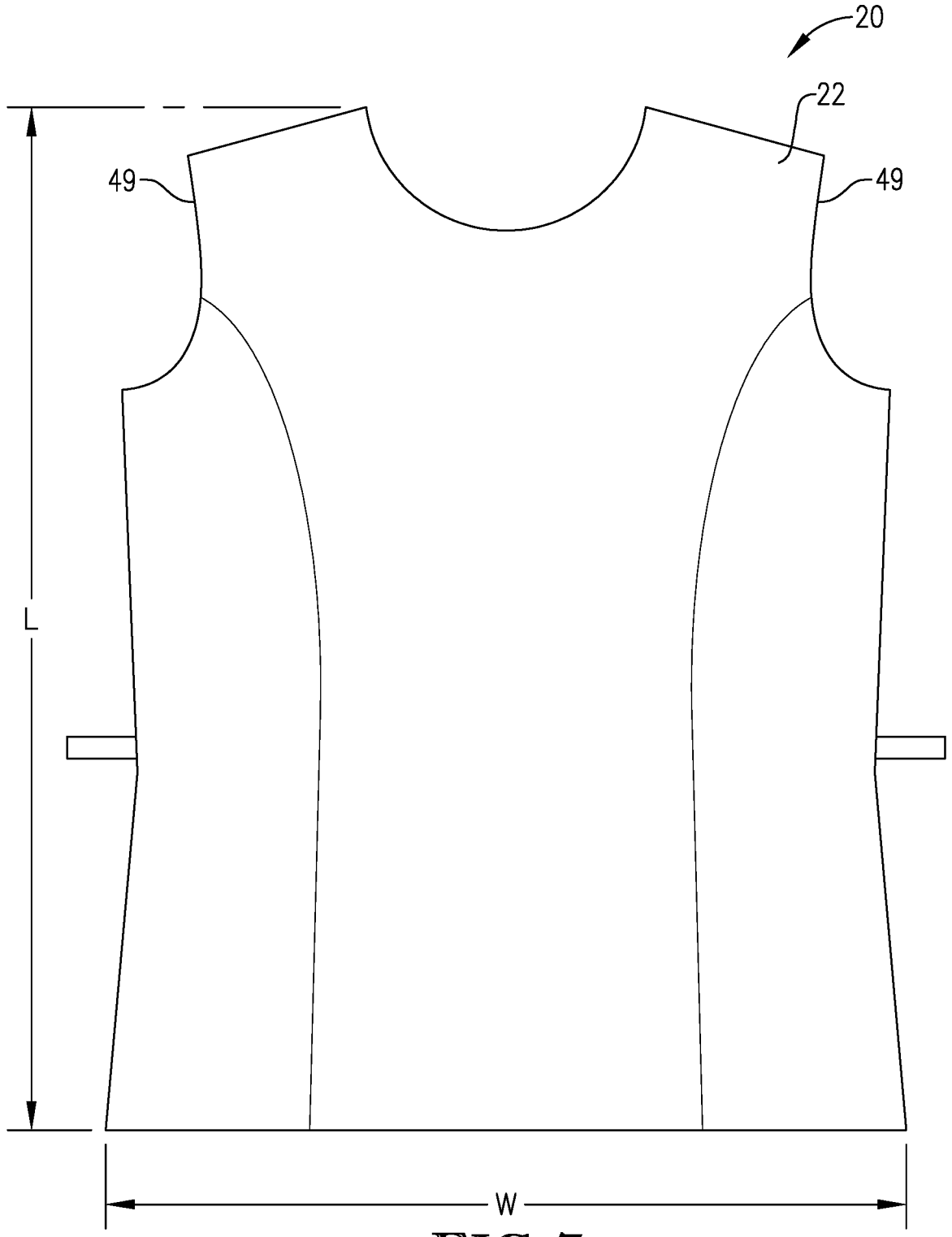
FIG. 7 is a schematic rear elevation of the adaptable protective garment shown in FIGS. 1-6, showing various dimensions of the garment.

Turning to FIGS. 6 and 7, the garment 20 preferably presents a garment length dimension L that ranges from about ten inches (10") to about sixty inches (60") and, more preferably, ranges from about eighteen inches (18") to about thirty-six inches (36"). The length dimension L of the illustrated garment 20 is most preferably about twenty-five inches (25").

However, the principles of the present invention are applicable where the length dimension L is outside of the above-referenced ranges, as will be shown in an alternative embodiment.

The illustrated garment 20 is preferably provided as a vest that is worn over the wearer's regular daily clothing, such as a shirt, blouse, sweat shirt, jacket, etc. However, the principles of the present invention are applicable to other types of garments. For instance, the garment 20 could be configured as a long sleeved robe, dress, shirt, jacket, or coat. Furthermore, features of the present invention could be integrated into a pair of pants. Yet further, for some aspects of the present invention, the garment 20 could comprise a hat, a blanket, a scarf, or another wearable clothing item.

Turning to FIGS. 1-5, each of the outer pocket layers 30 preferably comprises a continuous web of resilient sheet material. The outer pocket layers 30 are preferably sewn to the outer layer 22 along respective outer pocket seams 62 (see FIG. 1). The outer pocket seams 62 define attachment margins 64 along which the outer layer 22 and the outer pocket layers 30 are fixed to each other to cooperatively form exterior pockets 66 of the garment 20 (see FIG. 8). The attachment margins 64 are preferably configured so that the outer layer 22 and outer pocket layer 30 cooperatively present an open pocket top 68 that communicates with the corresponding exterior pocket 66.

Similarly, the inner pocket layers 28 each preferably include a continuous web of resilient sheet material. The inner pocket layers 28 are preferably sewn to the liner layer 26 along respective inner pocket seams 70 (see FIG. 3). The inner pocket seams 70 define attachment margins 72 along which the liner layer 26 and the inner pocket layers 28 are fixed to each other to cooperatively form interior breast pockets 74,75 of the garment 20 (see FIG. 3). The attachment margins 72 are preferably configured to partly enclose the respective breast pocket 74,75. The liner layer 26 and inner pocket layer 28 include adjacent upper pocket margins that cooperatively present an open pocket top 76. The open pocket top 76 communicates with the corresponding interior breast pocket 74,75.

As with seams 42, the illustrated seams 62,70 preferably fix the corresponding layers to one another. In particular, the seams 62,70 preferably include a series of stitches that are sewn through the corresponding layers to permanently fix the layers to one another. The stitches are preferably formed by a continuous length of synthetic resin thread material. However, as described concerning seams 42, the seams 62,70 could be formed by an alternative layer fastening structure without departing from the scope of the present invention.

The upper pocket margins of the liner layer 26 and the inner pocket layer 28 are detached from each other and are permitted to move to a limited extent relative to one another (see FIG. 3). However, each pair of upper pocket margins could be removably connected to one another to selectively close the respective open pocket top 76 and restrict relative movement between the upper pocket margins. For instance, conventional fasteners, such as a zipper, button, snap, or hook-and-loop material, could be fixed to the upper pocket margins and used to removably connect the upper pocket margins.

The outer layer 22, liner layer 26, inner pocket layer 28, and outer pocket layer 30 each preferably comprise a fabric sheet made at least partly of synthetic resin material. Preferably, the fabric sheet material and configuration are selected so that the layers are breathable and comfortable to wear while being washable. More preferably, the layers 22,26,28,30 preferably include a one hundred percent urethane-coated polyester knit material. This knit material preferably includes material that is flame resistant, bacterial resistant, and abrasion resistant. The knit material also preferably includes an antibacterial fabric that inhibits the growth and transmission of bacteria, such as *Staphylococcus* and *Klebsiella pneumoniae*.

However, one or more of the layers 22,26,28,30 could include an alternative material without departing from the scope of the present invention. For instance, the fabric material of the layers 22,26,28,30 could alternatively include cotton, spandex, or any combination thereof.

The depicted garment 20 preferably includes torso pockets 58,59,60 and breast pockets 74,75. However, as will be shown in a subsequent embodiment, the garment 20 could have an alternative pocket configuration. For instance, one or more of the pockets 58,59,60,74,75 could be alternatively shaped. Also, the garment 20 could be alternatively constructed so as to be devoid of one or more of the pockets 58,59,60,74,75. For some aspects of the present invention, the garment 20 could be devoid of any pockets (e.g., where pads 32,34,36 are alternatively mounted as part of the garment 20).

Each fill layer 24 preferably includes a continuous web of a relatively flexible woven batting material that serves as a pad and also serves as insulation for the garment 20. Each of the illustrated fill layers 24 is shaped to be received in a corresponding one of the torso pockets 58,59,60. The fill layers 24 are preferably secured to corresponding portions of the outer layer 22 by quilting seams (not shown) that are sewn to interconnect the outer layer 22 and the fill layers 24.

The woven batting material of the fill layer 24 preferably includes a synthetic resin material, although other materials are within the scope of the present invention. The material and configuration of the fill layer 24 are preferably selected so that the fill layer 24 is breathable and comfortable to wear while also being washable. While each fill layer 24 preferably comprises a woven batting, an alternative pad construction could be used for one or more of the fill layers 24. For instance, one or more of the fill layers 24 could include an alternative woven fabric, a flexible synthetic resin foam material, animal feathers, etc.

Each of the removable torso pads 32,34 is unitary and preferably comprises a continuous web of flexible cushioning material. More preferably, the torso pads 32,34 include a flexible foam layer that comprises a synthetic resin material. Each torso pad 32,34 is elongated and presents corresponding upper and lower pad ends 32*a*,34*a*. The torso pads 32,34 are shaped to be removably received in a corresponding one of the torso pockets 58,59,60. Consequently, the torso pads 32,34 cooperate with the layers 22,26 of the garment 20 to provide the garment 20 with additional cushioning. The torso pad 32,34 presents a pad thickness dimension Tt (see FIG. 5) that preferably ranges from about one quarter inch (¼") to about one half inch (½").

Figure 4:
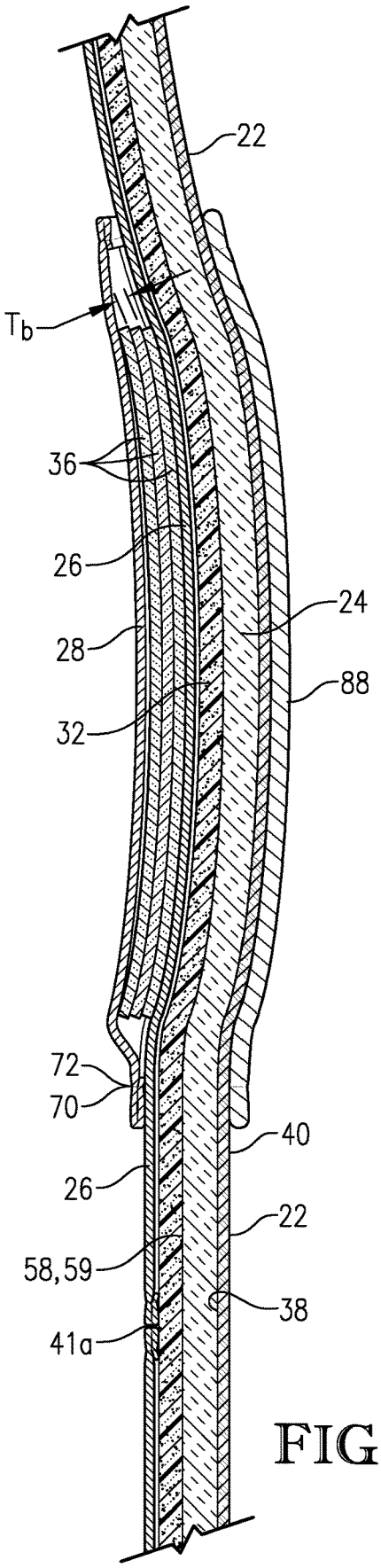
FIG. 4 is a fragmentary cross section of the adaptable protective garment taken along either of lines 4-4 in FIG. 3.
Figure 5:
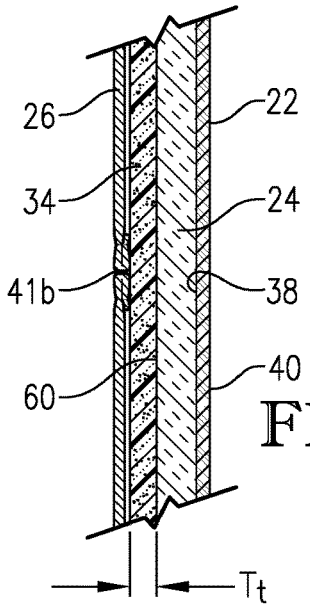
FIG. 5 is a fragmentary cross section of the adaptable protective garment taken along lines 5-5 in FIG. 3.

The torso pads 32,34 are preferably flexible and permit the garment 20 to conform to the shape of the wearer. The illustrated torso pads 32,34 have an unflexed, relaxed condition where the front and back surfaces of each pad generally have a planar shape. When inserted as part of the garment 20, each torso pad 32,34 can flex out of the relaxed condition and into a flexed condition where the pad is curved and conforms to the shape of the wearer (see FIG. 4). For instance, the front torso pads 32 are preferably configured to flex into a curved condition that conforms to the breast pads 36. However, one or more of the torso pads 32,34 could be curved in the relaxed condition. For example, in the relaxed condition, the front torso pads 32,34 could be normally curved (e.g., as shown in FIG. 4). In some alternative embodiments, the torso pads 32,34 could be normally curved so that no breast pads 36 are needed in the garment 20.

The torso pads 32,34 each preferably have a thickness that is substantially constant along the pad length. However, it is within the scope of the present invention where one or more of the torso pads 32,34 has a variable thickness. For instance, the front torso pads 32,34 could have a relatively greater thickness at a location adjacent the breast pads 36 (e.g., to provide greater protection for a mastectomy patient).

Each torso pad 32,34 is removably inserted into the corresponding torso pocket 58,59,60 by inserting the pad 32,34 through the respective access slit 41. Specifically, one of the pad ends 32*a*,34*a* is inserted through the respective access slit 41*a*,*b* to position the pad end 32*a*,34*a* adjacent the respective pocket end 58*a*,59*a*,60*a*. The torso pad 32,34 is then folded to insert the other pad end 32*a*,34*a* through the access slit 41*a*,*b* to position the other pad end 32*a*,34*a* adjacent the respective pocket end 58*a*,59*a*,60*a*.

The illustrated torso pockets 58,59,60 each receive a single torso pad 32,34. However, it is within the scope of the present invention where an alternative number of torso pads 32,34 are inserted into any one of the torso pockets 58,59,60. For instance, one of the torso pockets 58,59,60 could have multiple torso pads 32,34 received therein and stacked in registration with one another. However, for some aspects of the present invention, one or both of the torso pockets 58,59,60 could be devoid of torso pads 32,34. It will be appreciated that one or more torso pads 32,34 can be selectively placed in each of the torso pockets 58,59,60, depending on the location of the medical treatment and/or medical condition and as the wearer otherwise prefers (e.g., to provide comfort and protection to the wearer and/or to assist the wearer in maintaining a normal physical appearance). For instance, if the wearer has back surgery, the wearer may elect to include one or more torso pads 34 in the back torso pocket 60, while keeping the front torso pockets 58,59 empty (i.e., so that the front torso pockets 58,59 have no torso pads 32). Similarly, if the wearer has a mastectomy, the wearer may choose to include one or more torso pads 32 in front torso pockets 58,59 while leaving the back torso pocket 60 empty.

Each of the removable breast pads 36 is unitary and preferably comprises a continuous web of flexible cushioning material. More preferably, the breast pads 36 each include a flexible foam layer that comprises a synthetic resin material. The breast pads 36 are preferably shaped to be removably received in a corresponding one of the breast pockets 74,75. The breast pads 36 cooperate with the layers 22,26 of the garment 20 to provide the garment 20 with additional cushioning. The illustrated breast pad 36 presents a pad thickness dimension Tb (see FIG. 4) that ranges from about one millimeter (1 mm) to about five millimeters (5 mm) and, more preferably, is about three millimeters (3 mm).

Each breast pad 36 is removably inserted into the corresponding breast pocket 74,75 by inserting the pad 36 through the respective open pocket top 76 and sliding the breast pad 36 into the breast pocket 74,75.

The illustrated breast pockets 74,75 each preferably receive three (3) of the breast pads 36 stacked in registration with one another. Thus, the total thickness dimension of the illustrated stack of breast pads 36 preferably ranges from about three millimeters (3 mm) to about fifteen millimeters (15 mm) and, more preferably, is about nine millimeters (9 mm).

However, it is within the scope of the present invention where an alternative number of breast pads 36 are inserted into the same breast pocket 74,75. For instance, one of the breast pockets 74,75 could have a single breast pad 36 received therein. Also, for some aspects of the present invention, one or both of the breast pockets 74,75 could be devoid of breast pads 36. It will be appreciated that one or more breast pads 36 can be selectively placed in each of the breast pockets 74,75, depending on the location of the medical treatment and/or medical condition and as the wearer otherwise desires (e.g., to provide comfort and protection to the wearer and/or to assist the wearer in maintaining a normal physical appearance). Again, depending on the location of the procedure, one or both of the breast pockets 74,75 could be left without any breast pads 36 located therein.

The material and configuration of the torso pads 32,34 and breast pads 36 are preferably chosen so that the pads 32,34,36 are breathable and comfortable to wear while being washable. While each pad 32,34,36 preferably comprises a layer of flexible foam material, one or more of the pads 32,34,36 could include an alternative material. For instance, one or more of the pads 32,34,36 could include batting material, woven fabric, animal feathers, etc.

Each of the pads 32,34,36 preferably has a unitary construction. However, for some aspects of the present invention, one or more of the pads could include a plurality of pad pieces that cooperatively provide an alternative padding structure.

Yet further, one or more of the pads 32,34,36 could include a fluid-filled pad. Such a flexible, fluid-filled pad could include a flexible pad structure that presents one or more pockets filled with a fluid. The fluid material contained within the one or more pockets could include a gas and/or a liquid. The pad structure could contain one or more of various liquids, such as water. Furthermore, the fluid material could comprise a viscous liquid, such as a gel material.

It is also within the scope of the present invention where an alternative weighting material is selectively inserted in the garment 20 for the purpose of providing a weighted garment. For instance, weight in the form of metallic pellets (not shown) could be inserted within one or more of the torso pockets. Similarly, one or more of the pads 32,34,36 could be formed to include metal pellets and/or metal strips to provide additional weight to the garment 20.

The torso pads 32,34 and breast pads 36 can be selectively inserted and removed from the remainder of the garment 20 by the wearer (or another person). Insertion and removal of the torso pads 32,34 and breast pads 36 is preferably done while the garment 20 is removed from the wearer (i.e., prior to donning of the garment 20). However, it is within the scope of the present invention where at least one of the pads 32,34 is inserted and/or removed while the garment 20 is donned.

For some aspects of the present invention, any of the pads 32,34,36 could be fixed as an integral part of the garment 20. For instance, any of the pads 32,34,36 could be fixed within the corresponding pocket (e.g., where the pad is sewn to one or both of the layers forming the pocket). Also, for some aspects of the invention, any of the pads 32,34,36 could be constructed as an integral part of a hidden garment layer (such as the pocket layer 28). For instance, where the garment 20 is devoid of any pockets, the pads 32,34,36 could be integrally formed as part of a hidden garment layer. Yet further, an alternative padding arrangement could be constructed to simply provide an internal space that restricts an exterior force applied to the garment 20 from being transferred to the wearer. Similar to the illustrated embodiments, it will be appreciated that such alternative padding arrangements could be configured to provide one or more protective sections of the garment 20 with additional cushioning, flexibility, and/or "give."

Figure 2:
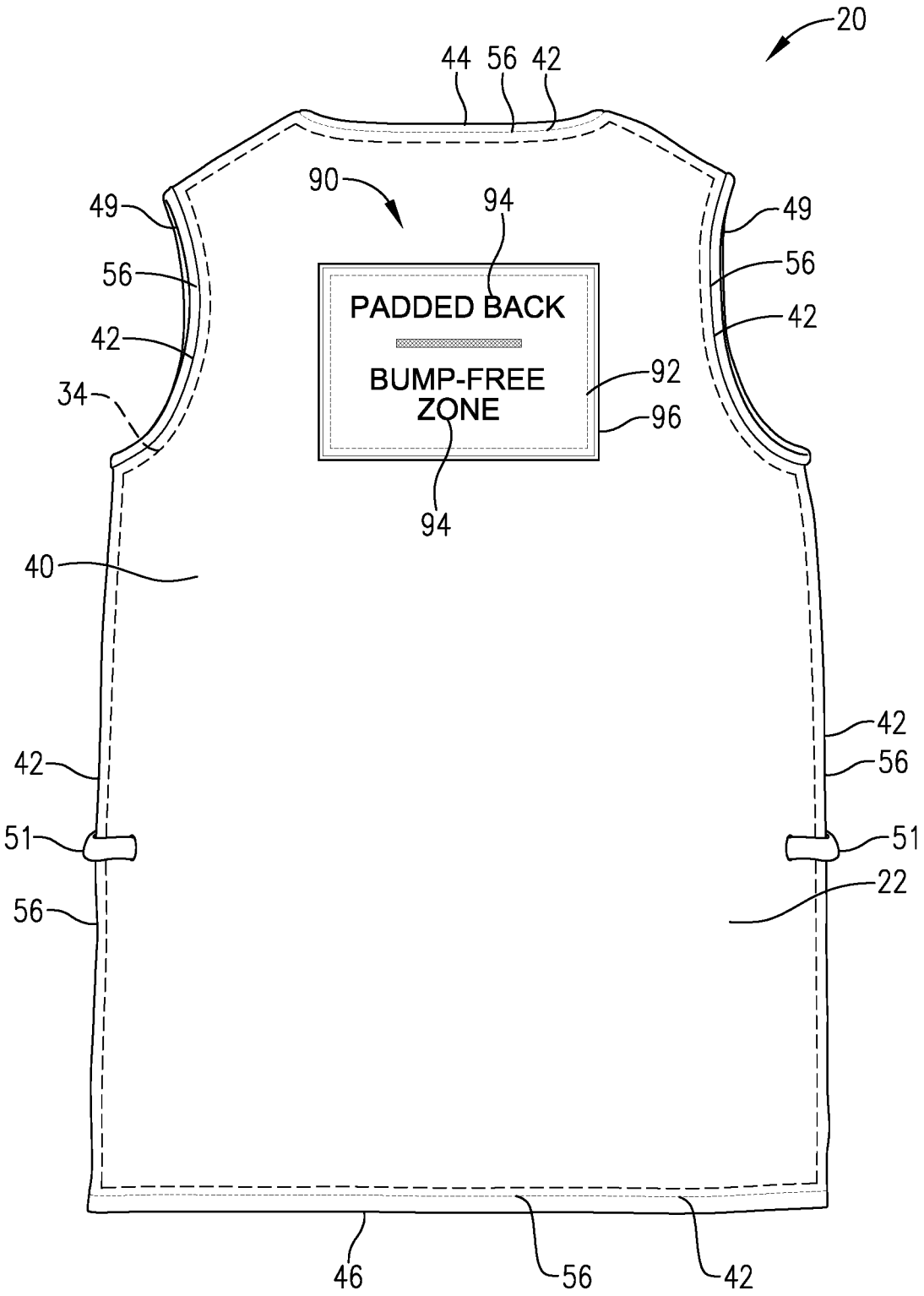
FIG. 2 is a rear elevation of the adaptable protective garment shown in FIG. 1.

Turning to FIGS. 1 and 2, the garment 20 preferably includes multiple instances of exposed front indicia 80,81 that visibly identify the location of the torso pocket 58 and breast pocket 74 along the exterior surface 40. As will be discussed, the indicia 80,81 are particularly desirable to identify locations of the pockets 58,74 when the garment 20 is donned. By identifying these features, the indicia 80,81 serve to identify and warn other people of the presence and location of sensitive areas associated with the wearer. The exposed front indicia 80,81 include an outer box indicia 82, an inner octagon indicia 84, and an inner message indicia 86,87.

Turning to FIG. 1, the exposed front indicia 80,81 are preferably secured to the exterior surface 40 of the outer layer 22 and are viewable when the garment 20 is donned. In the illustrated embodiment, the exposed front indicia 80,81 comprises a printed layer that is printed onto flexible substrate patches 88,89 that are sewn onto the outer layer 22. However, the exposed front indicia 80,81 could be alternatively secured to the outer layer 22. For instance, the front indicia 80,81 could comprise a printed layer (not shown) that is printed directly onto the exterior surface 40.

While the front indicia 80,81 are preferably fixed to the outer layer 22, the front indicia 80,81 could be removably attached to the outer layer 22. For instance, the illustrated patches 88,89 could be removably attached to the outer layer 22 with hook-and-loop material (e.g., where a strip of hook material is fixed to the outer layer 22 and a strip of loop material is fixed to the patch 88,89).

The exposed front indicia 80 is preferably located adjacent to the corresponding torso pocket 58 and breast pocket 74 to visibly identify the location of these pockets 58,74 along the exterior surface 40. Similarly, the front indicia 81 is preferably located adjacent to the corresponding torso pocket 58 to visibly identify the location of the torso pocket 58 along the exterior surface 40.

In the illustrated embodiment, the octagon and message indicia 84,86 of indicia 80 overlie both the torso pocket 58 and the breast pocket 74. That is, the octagon and message indicia 84,86 of indicia 80 are superposed with the pockets 58,74. Because the torso and breast pockets 58,74 are generally hidden from view when the garment 20 is donned, the superposed positioning of the octagon and message indicia 84,86 of indicia 80 identifies the location of these hidden pockets 58,74 along the exterior surface 40.

The illustrated box indicia 82 of front indicia 80 overlies the torso pocket 58 and surrounds the breast pocket 84 in a non-overlying position. Thus, the box indicia 82 of front indicia 80 is superposed with the torso pocket 58. Because the torso pocket 58 is generally hidden from view when the garment 20 is donned, the superposed positioning of the box indicia 82 identifies the location of the hidden torso pocket 58 along the exterior surface 40.

Furthermore, the box indicia 82, octagon indicia 84, and message indicia 86 of front indicia 80 can be used to identify the presence of front torso pads 32 and/or breast pads 36 in the garment 20. For instance, if the front torso pads 32 and/or breast pads 36 are permanently inserted within the corresponding front torso pockets 58,59 and/or breast pockets 74,75, the inserted pads 32,36 are generally hidden from view when the garment 20 is donned. However, the indicia 84,86 can be used to identify the presence of pads 32,36 within the garment 20 because the indicia 84,86 of front indicia 80 are generally superposed in relation to the front torso pads 32 and/or breast pads 36. The box indicia 82 of front indicia 80 can be used to identify the placement of pads 32,36 within the garment 20 because the box indicia 82 of front indicia are generally superposed in relation to the front torso pads 32 and in surrounding relationship to the breast pads 36.

The box indicia 82 of front indicia 80 is preferably not superposed with the breast pocket 74. However, the box indicia 82 endlessly surrounds the location of the breast pocket 74. Because the breast pocket 74 is generally hidden from view when the garment 20 is donned, the positioning of the box indicia 82 in a surrounding relationship to the breast pocket 74 identifies the location of the hidden breast pocket 74 along the exterior surface 40. Again, the box indicia 82 can also be used to identify the presence of front torso pads 32 and/or breast pads 36.

The box and message indicia 82,86 of front indicia 81 overlie the torso pockets 58 and are thereby superposed with the torso pockets 58. Because the torso pockets 58 are generally hidden from view when the garment 20 is donned, the superposed positioning of the box and message indicia 82,86 of front indicia 81 identifies the location of these hidden pockets 58 along the exterior surface 40.

Similarly, the box indicia 82 and message indicia 86 of front indicia 81 can be used to identify the presence of front torso pads 32 in the garment 20. For instance, if the front torso pads 32 are permanently inserted within the corresponding front torso pockets 58,59, the inserted pads 32 are generally hidden from view when the garment 20 is donned. However, the indicia 82,86 of the front indicia 81 can be used to identify the placement of pads 32 within the garment 20 because the indicia 82,86 of front indicia 81 are generally superposed in relation to the front torso pads 32.

Turning to FIG. 2, the garment 20 preferably includes exposed rear indicia 90 to visibly identify the location of the back torso pocket 60 along the exterior surface 40. The rear indicia 90 are particularly desirable to identify the location of the back torso pocket 60 when the garment 20 is donned. By identifying this feature, the indicia 90 serves to identify and warn other people of the presence and location of sensitive areas associated with the wearer. The rear indicia 90 includes an outer box indicia 92 and an inner message indicia 94.

The exposed rear indicia 90 is preferably secured to the exterior surface 40 of the outer layer 22 and is viewable when the garment 20 is donned. In the illustrated embodiment, the rear indicia 90 is printed onto a flexible substrate patch 96 that is sewn onto the outer layer 22. However, the rear indicia 90 could be alternatively secured to the outer layer 22. For instance, the rear indicia 90 could comprise a printed layer (not shown) that is printed directly onto the exterior surface 40.

While the rear indicia 90 are preferably fixed to the outer layer 22, the rear indicia 90 could be removably attached to the outer layer 22. For instance, the illustrated patch 96 could be removably attached to the outer layer 22 with hook-and-loop material (e.g., with a strip of hook material fixed to the outer layer 22 and a strip of loop material fixed to the patch 96).

The rear indicia 90 is preferably located adjacent to the back torso pocket 60 to visibly identify the location of the pocket 60 along the exterior surface 40. In the illustrated embodiment, the box indicia 92 and message indicia 94 overlie the back torso pocket 60. That is, the box indicia 92 and message indicia 94 are superposed with the back torso pocket 60. Because the back torso pocket 60 is generally hidden from view when the garment 20 is donned, the superposed positioning of the box indicia 92 and message indicia 94 identifies the location of this hidden pocket 60 along the exterior surface 40.

The front and rear indicia 80,90 are preferably located adjacent to corresponding hidden pockets and/or pads to identify the presence of these features to others located near the wearer. However, the front and rear indicia 80,90 could be configured to identify the presence of other types of padding arrangements, as discussed above, that provide additional cushioning, flexibility, and/or "give."

In use, the torso pads 32,34 and breast pads 36 can be selectively inserted and removed from the remainder of the garment 20 by the wearer (or another person). Insertion and removal of the torso pads 32,34 and breast pads 36 is preferably done while the garment 20 is removed from the wearer (i.e., prior to donning of the garment 20). However, it is within the scope of the present invention where at least one of the pads 32,34 is inserted and/or removed while the garment 20 is donned.

Again, the illustrated garment 20 is preferably worn over the wearer's regular daily clothing, such as a shirt, blouse, sweat shirt, jacket, etc. Thus, the wearer dons these clothes prior to donning the garment 20. The garment 20 is preferably donned by inserting the wearer's arms (not shown) through the respective arm openings 49 so that the liner layer 26 comes into contact with the wearer's torso. The fastener 50 of the garment 20 can then be selectively opened and closed by the wearer.

Turning to FIGS. 8-20, alternative preferred embodiments of the present invention are depicted. For the sake of brevity, the remaining description will focus primarily on the differences of these alternative embodiments from the preferred embodiment described above. Each of the alternative garments described below preferably includes durable medical equipment that can be used repeatedly, by one or more post-operative users, to provide therapeutic comfort and protection.

Figure 8:
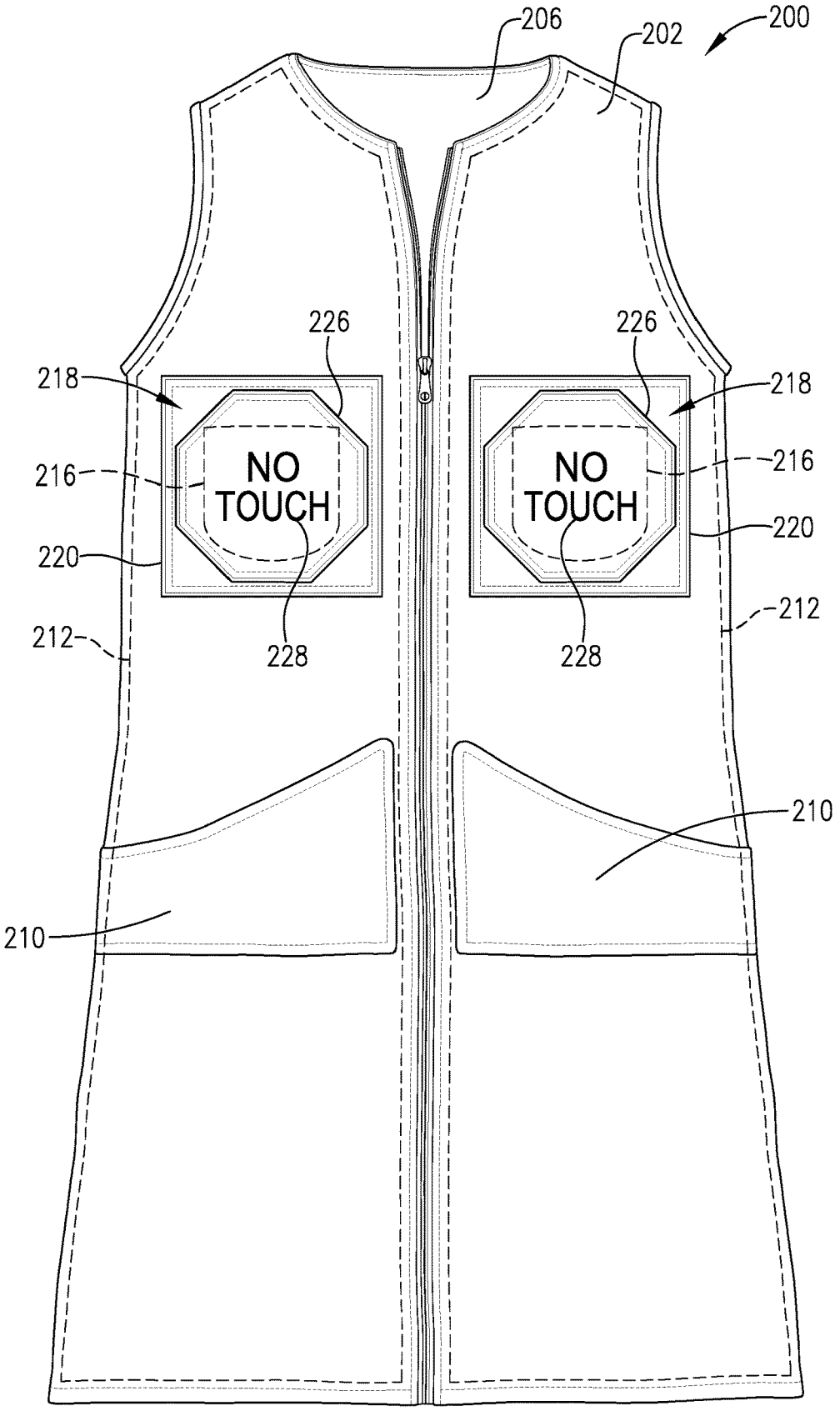
FIG. 8 is a front elevation of an adaptable protective garment constructed in accordance with a second preferred embodiment of the present invention.
Figure 9:
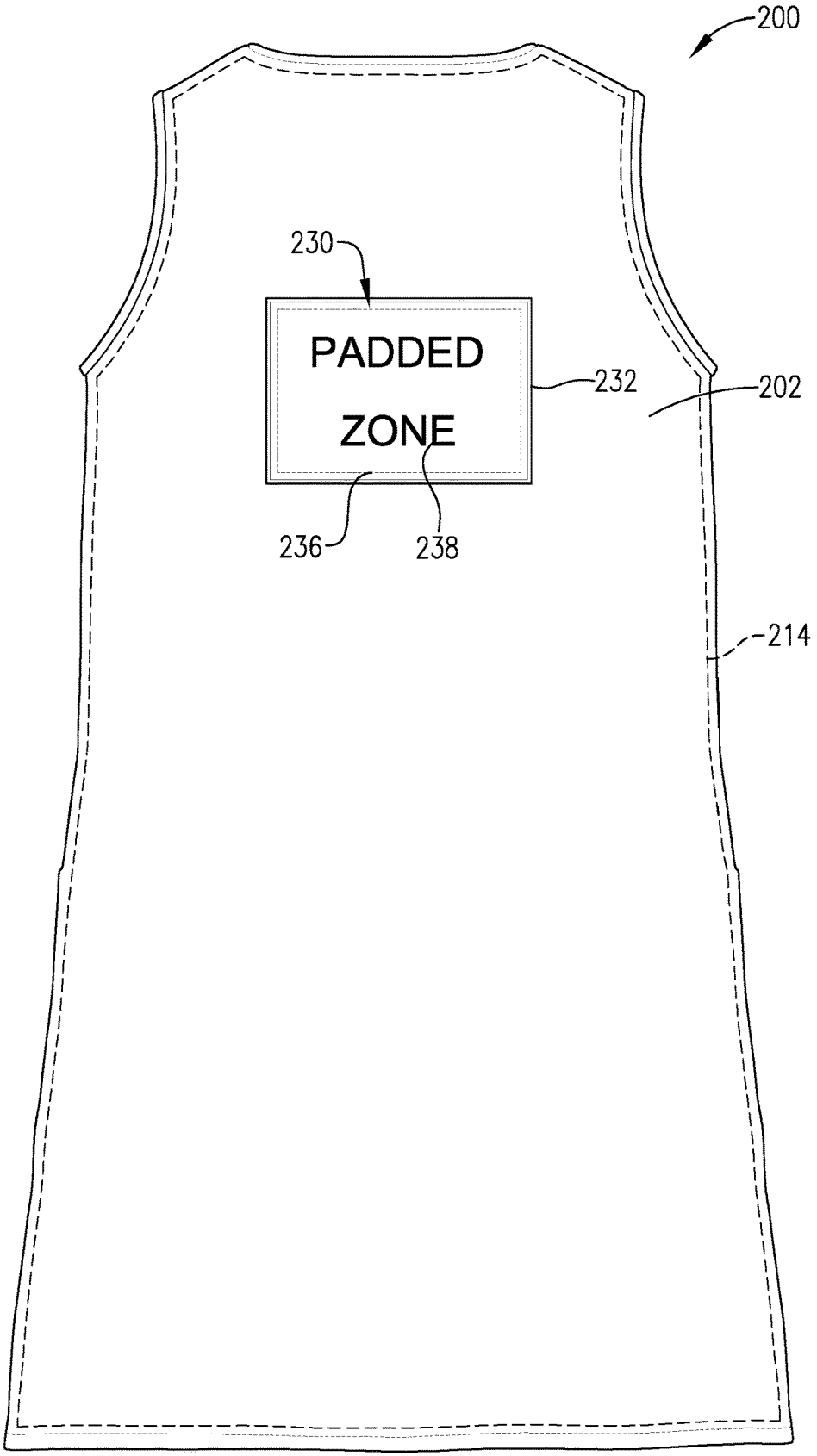
FIG. 9 is a rear elevation of the adaptable protective garment shown in FIG. 8.
Figure 10:
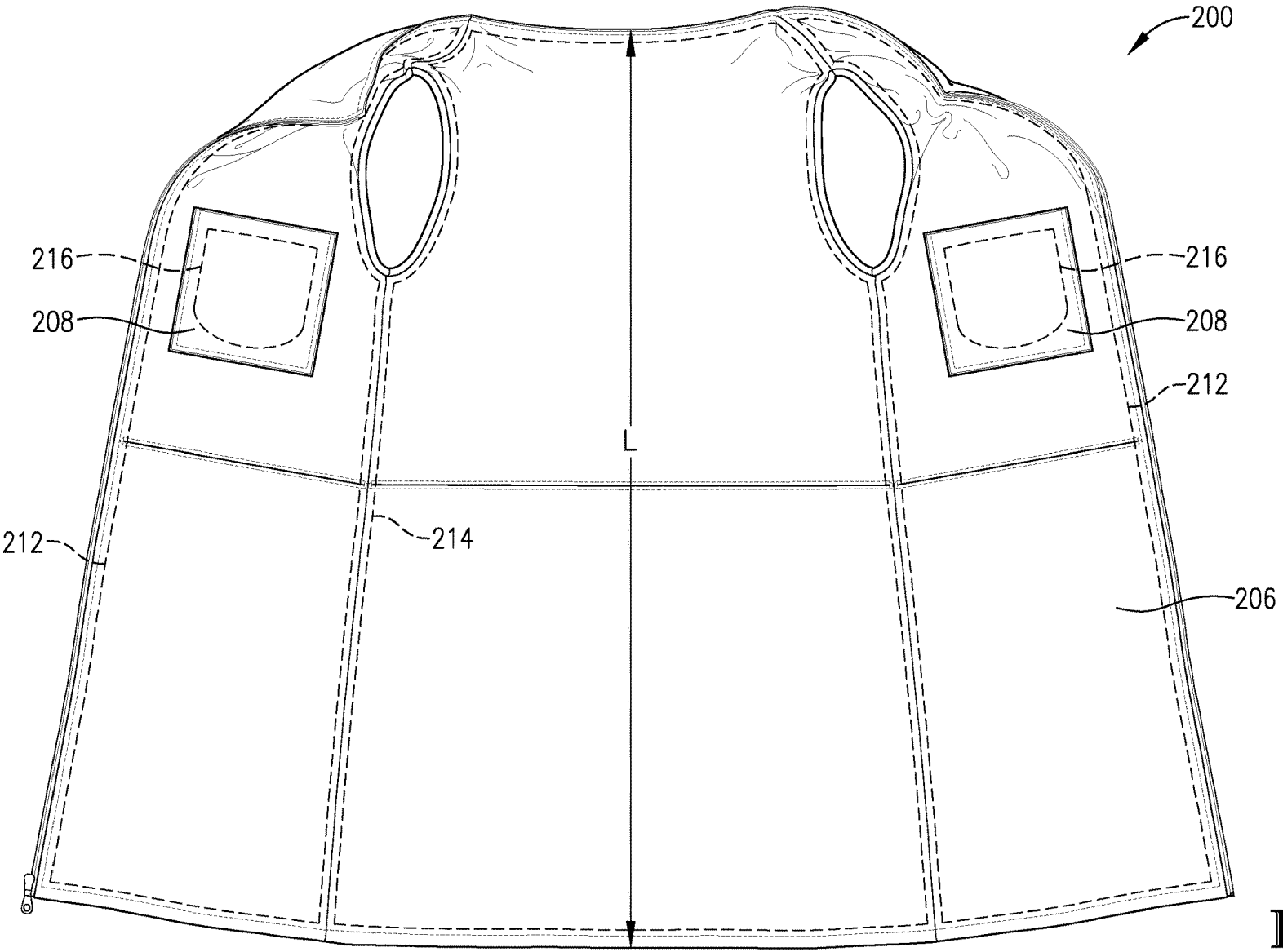
FIG. 10 is a front elevation of the adaptable protective garment similar to FIG. 8, but with the garment being opened to expose the interior of the garment.

Initially turning to FIGS. 8-10, an alternative garment 200 is constructed in accordance with a second embodiment of the present invention. The garment 200 preferably includes an outer layer 202, fill layers (not shown), an intermediate liner layer 206, inner pocket layers 208, outer pocket layers 210, removable front and back torso pads 212,214, and removable breast pads 216.

The garment 200 is configured to be worn as a full-length garment that extends to a lowermost location positioned anywhere from a location adjacent the wearer's knees to a location adjacent the wearer's ankles Thus, the garment 200 has an alternative length dimension L that is substantially longer than the length dimension of the garment 20. For instance, the length dimension L can range from about forty inches (40") to about seventy inches (70"). The length of the garment 200 is configured to protect a sensitive region that is located relatively lower on the wearer than regions to be protected by the garment 20. For instance, the garment 200 can be used to protect the trunk of the wearer (e.g., if the wearer has undergone a cesarean section or another type of abdominal surgery).

The garment 200 also preferably has alternative front indicia 218 defined on a patch 220. The front indicia 218 is positioned adjacent to corresponding breast pockets 222 and front torso pockets 224 and includes geometrical shape indicia 226 and message indicia 228.

The garment 200 further includes alternative rear indicia 230 defined on a patch 232. The rear indicia 230 is positioned adjacent to corresponding rear torso pocket 234 and includes geometrical shape indicia 236 and message indicia 238.

Figure 11:
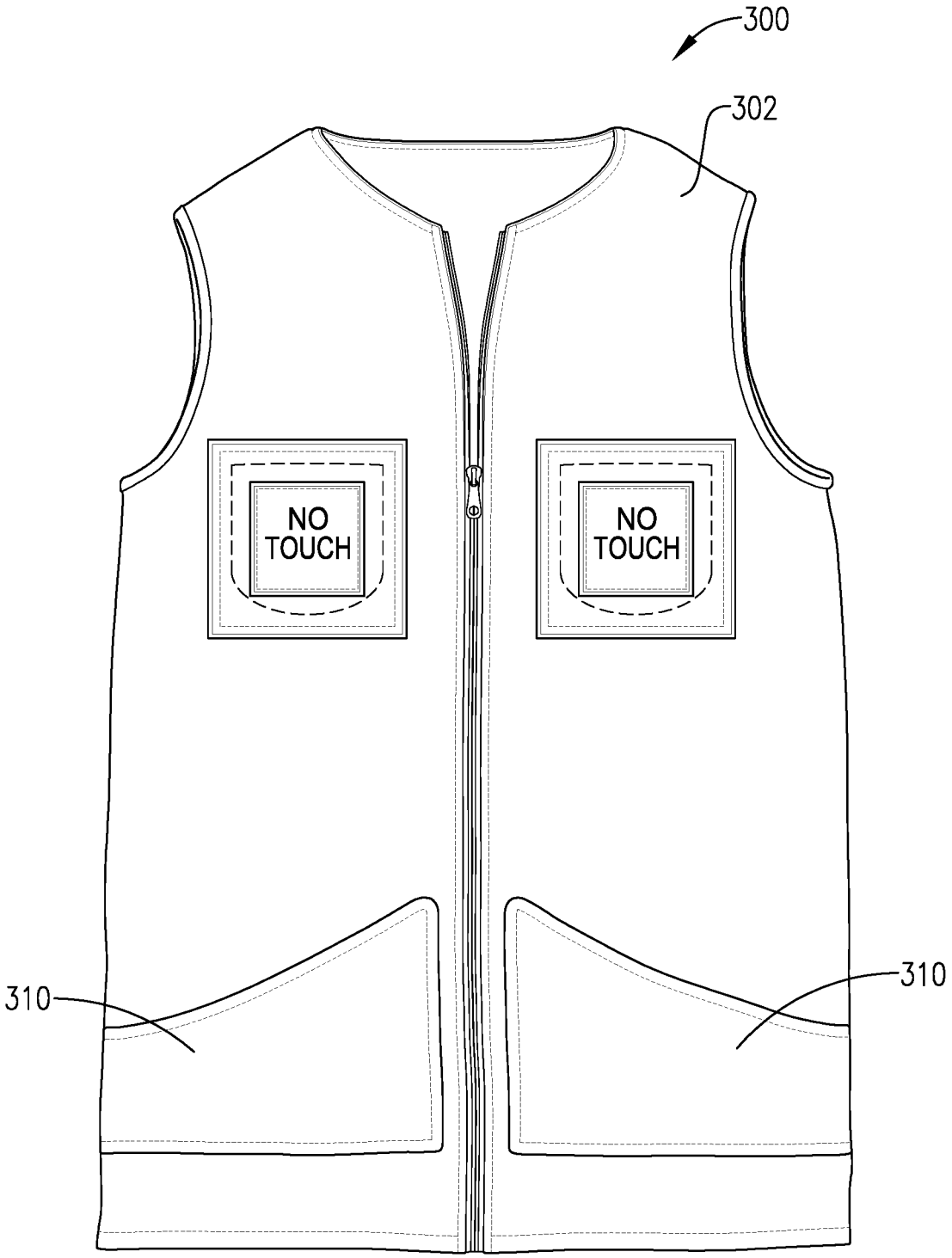
FIG. 11 is a front elevation of an adaptable protective garment constructed in accordance with a third preferred embodiment of the present invention.
Figure 12:
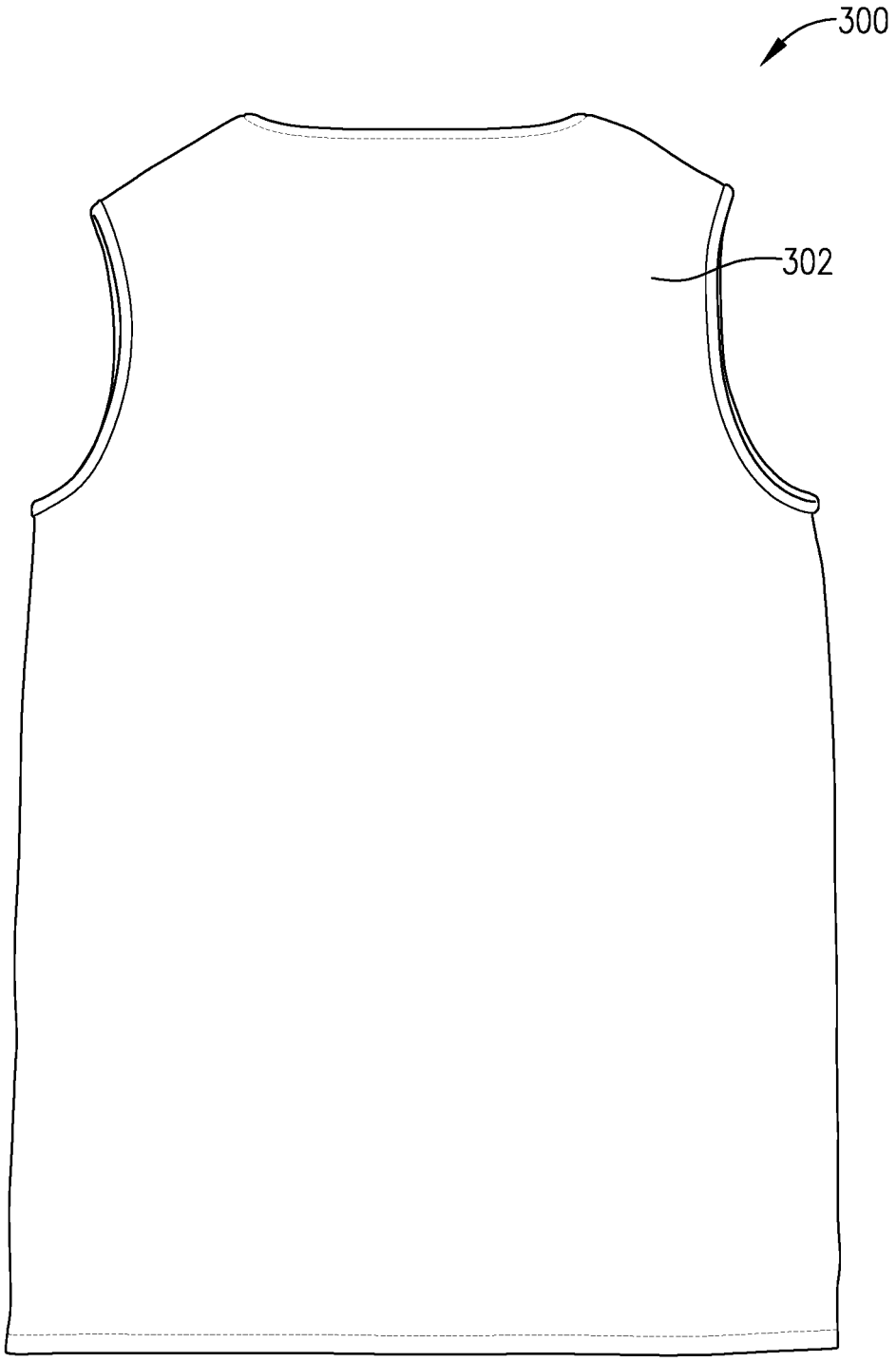
FIG. 12 is a rear elevation of the adaptable protective garment shown in FIG. 11.
Figure 13:
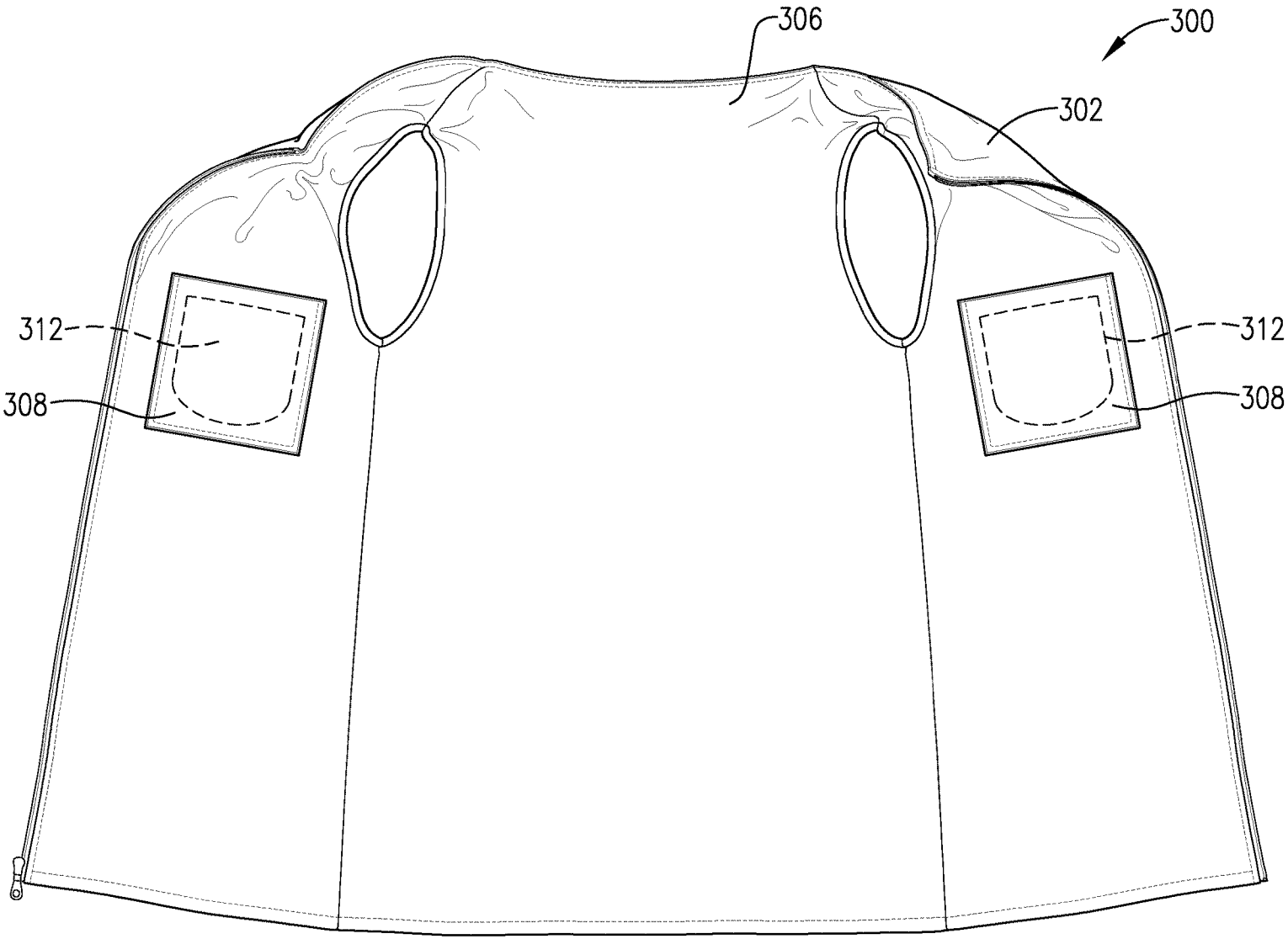
FIG. 13 is a front elevation of the adaptable protective garment similar to FIG. 11, but with the garment being opened to expose the interior of the garment.

Turning to FIGS. 11-13, an alternative garment 300 is constructed in accordance with a third embodiment of the present invention. The alternative garment 300 preferably includes an outer layer 302, fill layers (not shown), an alternative liner layer 306, inner pocket layers 308, outer pocket layers 310, and removable breast pads 312.

The illustrated garment 300 preferably does not include any of the full-length torso pads included in garment 20. Furthermore, the liner layer 306 is preferably devoid of any access slits, as found in garment 20. Thus, the garment 300 is not configured to have torso pads inserted between the layers 302,306 to provide padding along either the front or back of the garment 20. It will be appreciated that the illustrated garment 300 is particularly suited for donning by a mastectomy patient where comfort and protection is only required adjacent to the site of the surgical procedure.

Turning to FIGS. 14-20, an alternative garment 400 is constructed in accordance with a fourth embodiment of the present invention. The garment 400 preferably includes a garment outer shell 402, a removable garment inner liner 404, and a fluid transfer assembly 406.

As with garments 20,200,300 disclosed above, the garment 400 can be used to protect a portion of the wearer that is physically sensitive due to a variety of reasons. The illustrated garment 400 has features that are configured to protect and comfort the torso of a mastectomy patient. Preferably, the garment 400 is also configured to collect any fluid that drains from the surgical site of the mastectomy patient (generally while the garment 400 is donned by the patient).

Turning to FIGS. 14-18, the outer shell 402 provides an outermost protective shell of the garment 400. The shell 402 preferably includes, among other things, an outer layer 408, fill layer 410, intermediate liner layer 412, inner pocket layer 414, and removable front torso pad 416 (see FIG. 18).

Figure 14:
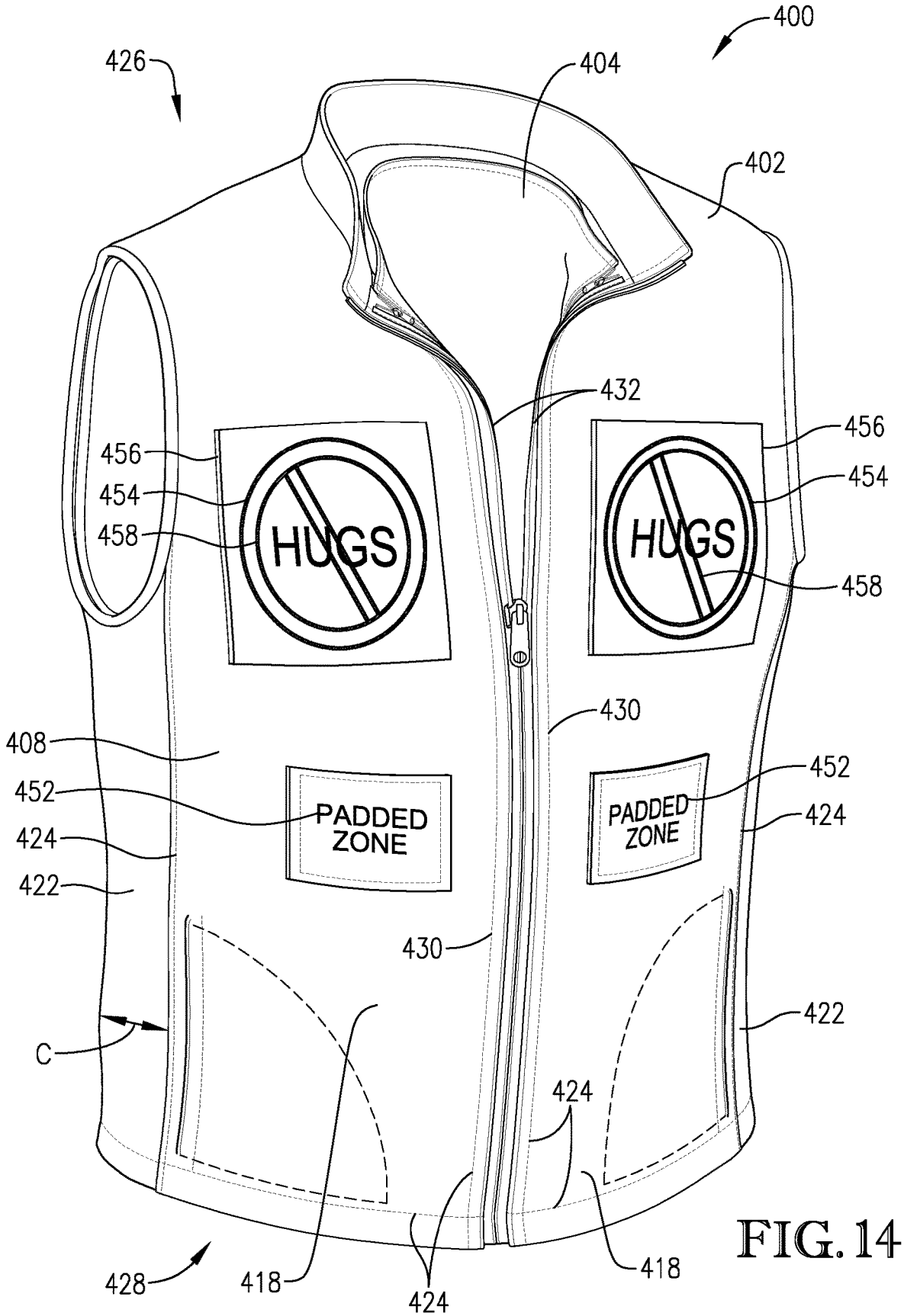
FIG. 14 is a front perspective of an adaptable protective garment constructed in accordance with a fourth preferred embodiment of the present invention, showing zipper fasteners of the garment attached to one another so that the garment is partly closed.
Figure 15:
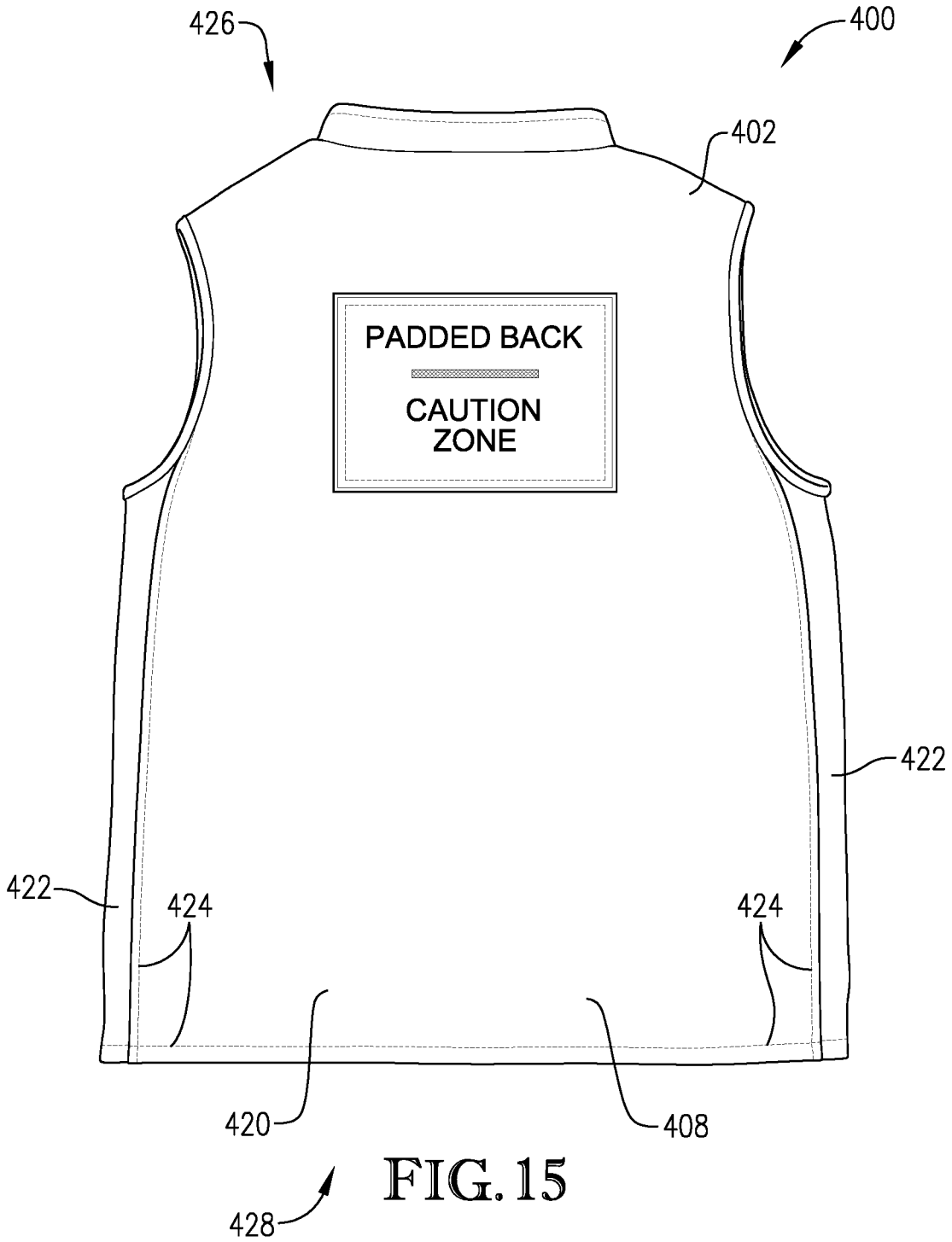
FIG. 15 is a rear elevation of the adaptable protective garment shown in FIG. 14.

The outer layer 408 preferably includes a pair of front panels 418, back panel 420, and a pair of side panels 422 (see FIGS. 14 and 15). Each of the illustrated side panels 422 is fixed to and interconnects the back panel 420 and a corresponding one of the front panels 418. Each of the panels 418,420,422 preferably comprises a continuous web of resilient sheet material.

The outer and liner layers 408,412 are each preferably symmetrical about a longitudinal axis of the garment 400. The illustrated layers 408,412 are shaped and sewn to each other along corresponding seams 424 (see FIGS. 14 and 15). The layers 408,412 cooperatively form an upper margin 426, lower margin 428, and upright garment fastening margins 430 of the garment 400 (see FIG. 17).

The garment 400 also preferably includes continuous fasteners 432 in the form of mating zipper fasteners to secure the fastening margins 430 to one another (see FIG. 14). In a secured condition (e.g., when the garment 400 is donned by the user), the fasteners 432 secure the fastening margins 430 at least partly to one another (see FIG. 14).

Figure 17:
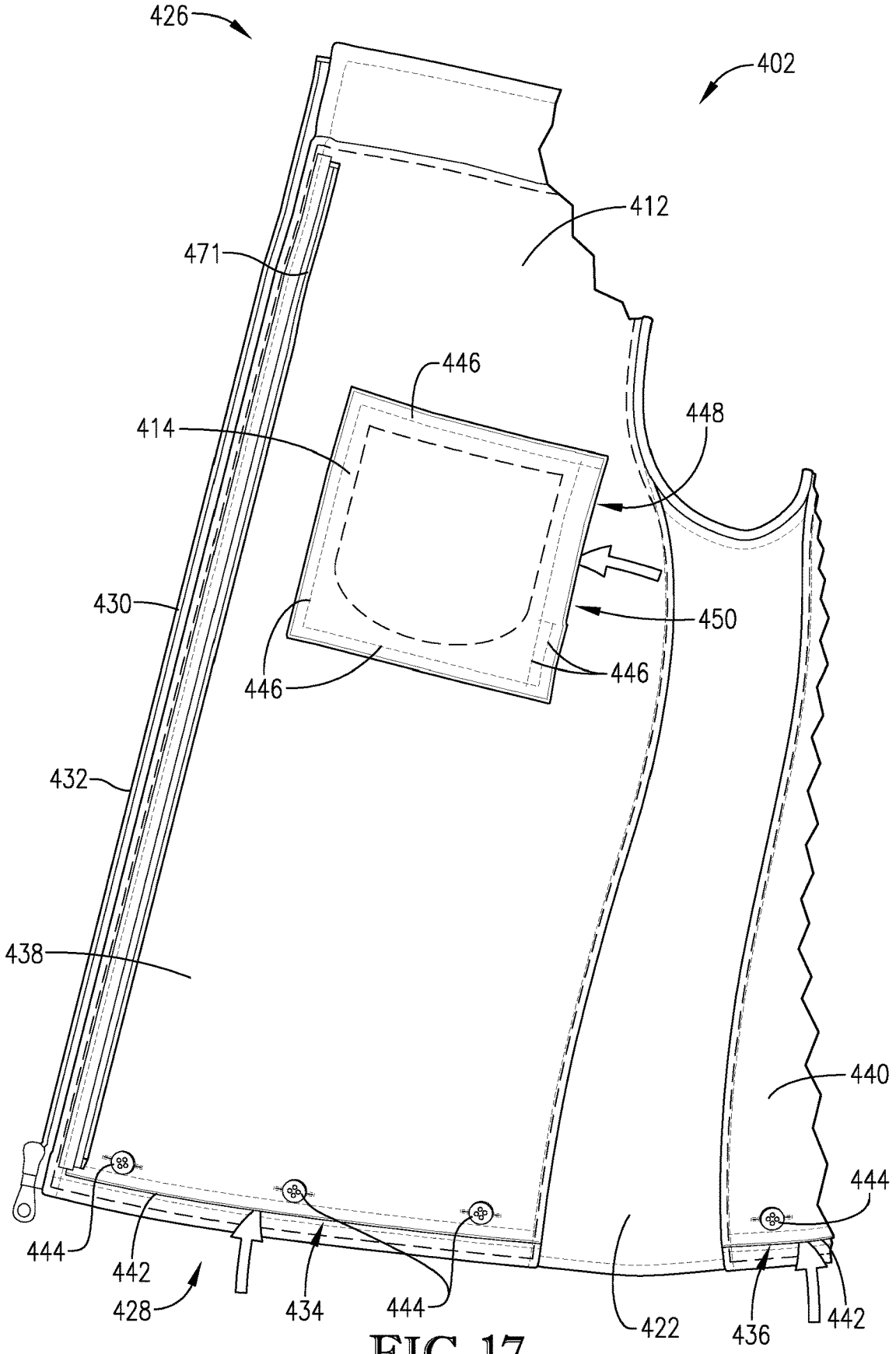
FIG. 17 is a fragmentary elevation of the adaptable protective garment similar to FIG. 16, but showing the inner liner and the fluid transfer assembly removed to expose an interior of the outer shell.
Figure 18:
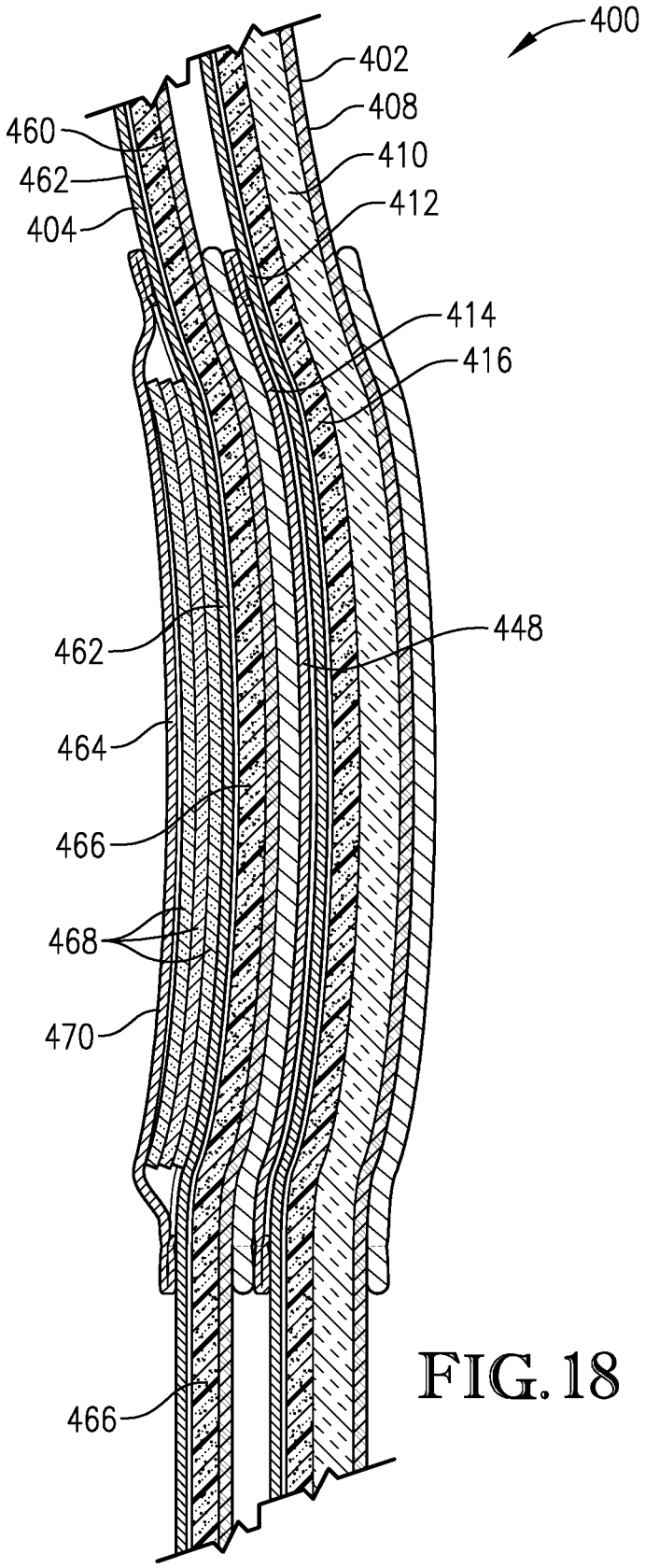
FIG. 18 is a cross section of the adaptable protective garment taken along line 18-18 in FIG. 16.

The illustrated seams 424 provide continuous attachment margins along which the outer and liner layers 408,412 are fixed to each other to cooperatively form a pair of front torso pockets 434 and a back torso pocket 436 of the garment 400 (see FIG. 17).

The illustrated torso pockets 434,436 are elongated and extend vertically along the length of the garment 20 to present corresponding interior pocket chambers and pocket ends located adjacent to corresponding upper and lower margins 426,428 of the garment 400.

Turning to FIG. 17, the illustrated liner layer 412 includes a pair of front liner panels 438 and a back liner panel 440 spaced apart from and located between the front liner panels 438. The front liner panels 438 cooperate with the front panels 418 of the outer layer 408 to form the front torso pockets 434. Similarly, the back liner panel 440 cooperates with the back panel 420 of the outer layer 408 to form the back torso pocket 436 (see FIG. 17).

The liner layer 412 preferably presents front and back access slits 442 that extend along the lower margin 428 and provide access to the interior chambers of corresponding torso pockets 434,436 (see FIG. 17). The outer shell 402 preferably includes buttons 444 located adjacent the slits 442. The buttons 444 are fixed to the outer layer 408 and are removably attached to a lower margin of the liner layer 412 by being insertable through corresponding slots in the lower margin. Thus, the buttons 444 are configured to selectively open and close the slits 442.

However, it is within the ambit of the present invention where an alternative fastener is removably connected to the lower margins of liner layer 412. For instance, other conventional removable fasteners, such as zippers, snaps, or hook-and-loop material could be used in place of the buttons.

Still referring to FIG. 17, the inner pocket layers 414 are preferably sewn to the liner layer 412 along respective inner pocket seams 446. The inner pocket seams 446 define attachment margins along which the liner layer 412 and the inner pocket layers 414 are fixed to each other to cooperatively form a pair of interior breast pockets 448 of the outer shell 402. The inner pocket layer 414 includes a side pocket margin that is not attached to the liner layer 414 so that the side pocket margin and the inner pocket liner 414 cooperatively present a side pocket opening 450. The opening 450 communicates with the corresponding interior breast pocket 448 and permits insertion and removal of one or more breast pads relative to the breast pocket 448.

Turning again to FIGS. 14-18, the outer layer 408, liner layer 412, and inner pocket layer 414 each preferably comprise a fabric sheet made at least partly of synthetic resin material. Preferably, the fabric sheet material and configuration are selected so that the layers are breathable and comfortable to wear while being washable.

More preferably, the layers 408,412,414 preferably include a one hundred percent urethane-coated polyester knit material. This knit material preferably includes material that is flame resistant, bacterial resistant, and abrasion resistant. The knit material also preferably includes an antibacterial fabric that inhibits the growth and transmission of bacteria, such as *Staphylococcus* and *Klebsiella pneumoniae*.

However, one or more of the layers 408,412,414 could include an alternative material without departing from the scope of the present invention. For instance, the fabric material of the layers 408,412,414 could alternatively include cotton, spandex, or any combination thereof.

The front and back panels 418,420 of outer layer 408 preferably include a flexible fabric sheet that includes a synthetic resin material. The illustrated front and back panels 418,420 are generally not elastically stretchable. However, for some aspects of the present invention, one or more of the panels 418,420 could include a stretchable material (such as an elastic material).

The side panels 422 preferably include a flexible fabric sheet that is relatively more stretchable than the front and back panels 418,420 and, more preferably, includes an elastically stretchable fabric. Most preferably, the side panels 422 preferably include an elastic spandex material. However, the side panels 422 could include an alternative stretchable material without departing from the scope of the present invention.

The side panels 422 preferably permit the garment 400 to elastically stretch along a circumferential direction C (see FIG. 14) that extends about the longitudinal axis of the garment 400 (and, when the garment 400 is donned, about the torso of the user). That is, the illustrated side panels allow the garment 400 to elastically expand and contract along the circumferential direction while the garment 400 is donned and secured on the user in a secured condition (for example, as shown in FIG. 14).

Again, the side panels 422 are preferably more stretchable than panels 418,420. It is believed that this construction restricts the panels 418,420 and pockets 434,436,448 from moving circumferentially relative to the user as the garment 400 expands and contracts along the circumferential direction.

The outer shell 402 preferably includes multiple instances of exposed front indicia 452,454 that visibly identify the location of the front torso pockets 434 and breast pockets 448 along the exterior surface (see FIG. 14). The exposed front indicia 454 include outer box indicia 456 and an inner message indicia 458. The front indicia 452,454 are printed onto flexible substrate patches that are sewn onto the outer layer.

In the illustrated embodiment, the indicia 454 overlie both the torso pocket 434 and the breast pocket 448. That is, the indicia 454 are superposed with the pockets 434,448. The box indicia 456 preferably overlies the torso pocket 434 and surrounds the breast pocket 448 in a non-overlying position.

Turning to FIGS. 16 and 18-20, the illustrated inner garment liner 404 comprises a zip-out liner that can be selectively attached to and removed from the outer shell 402. The illustrated liner 404 preferably has a generally symmetrical shape and includes an outer layer 460, intermediate liner layer 462, a pair of inner pocket layers 464, front torso pad 466, and removable breast pads 468 (see FIG. 18).

Figure 16:
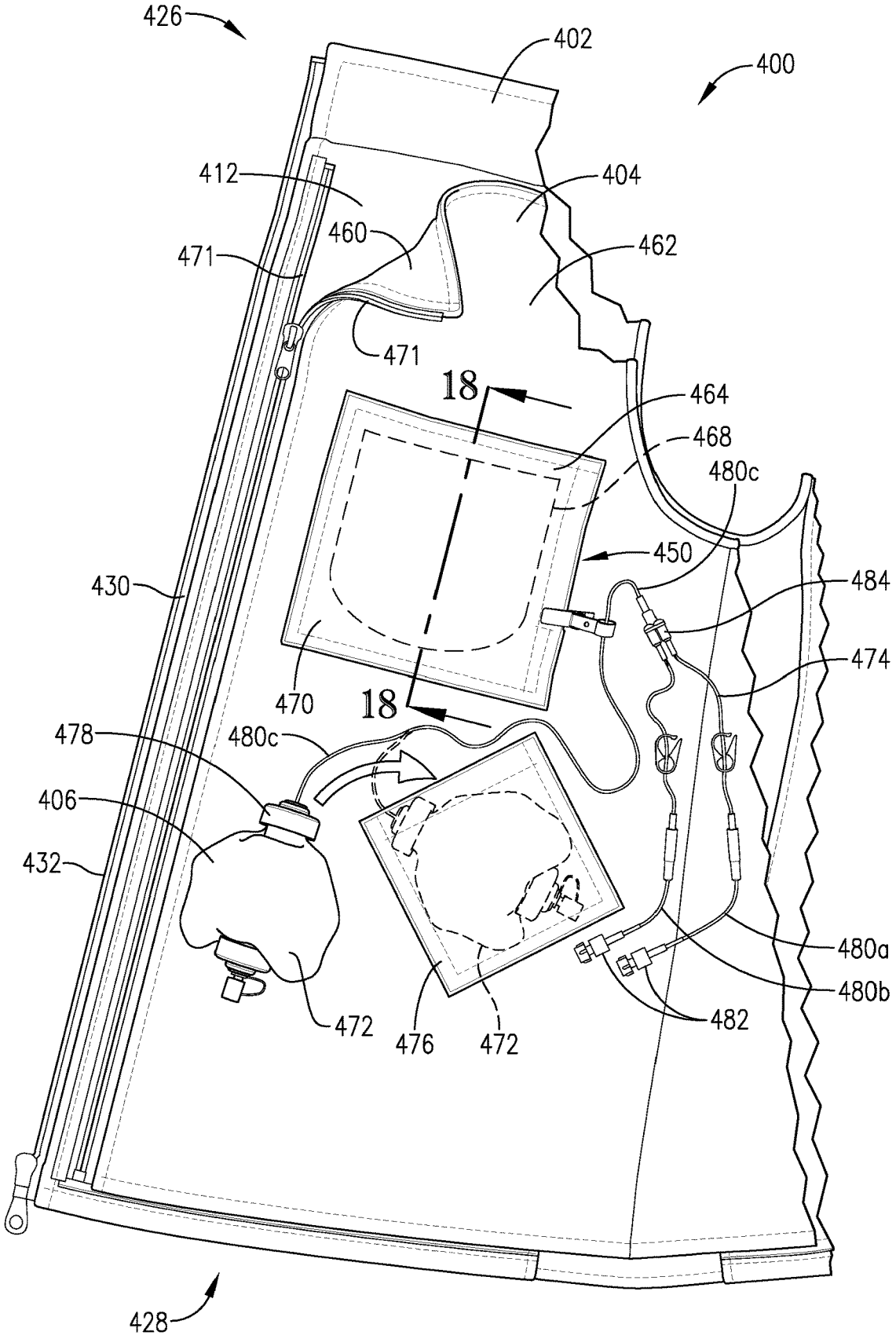
FIG. 16 is a fragmentary elevation of the adaptable protective garment shown in FIGS. 14 and 15, with the zipper fasteners being detached and the garment shown in an open condition to show the interior of the garment, showing an inner liner attached to an outer shell of the garment, and further showing a fluid transfer assembly of the garment attached to the inner liner.

Each inner pocket layer 464 is preferably sewn to the liner layer 462 along respective inner pocket seams (see FIG. 16). The inner pocket seams define attachment margins along which the liner layer 462 and the inner pocket layers 464 are fixed to each other to cooperatively form interior breast pockets 470 of the liner 404 (see FIG. 16).

The inner pocket layer 464 includes a side pocket margin that is not attached to the liner layer 462 so that the side pocket margin and the inner pocket liner 464 cooperatively present a side pocket opening 450. The opening 450 communicates with the corresponding interior chamber of the breast pocket 470 and permits insertion and removal of one or more breast pads relative to the breast pocket 470.

Figure 19:
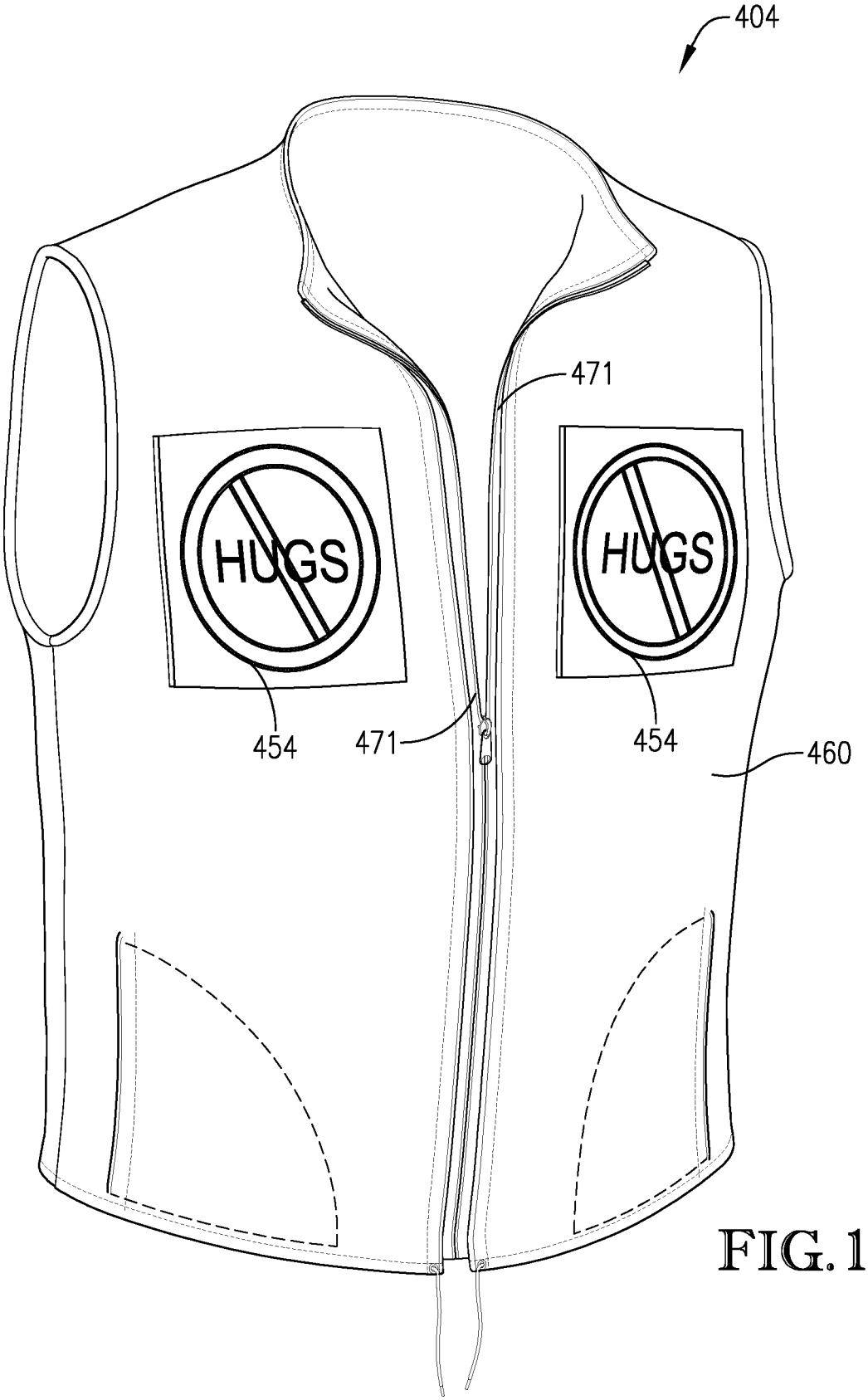
FIG. 19 is a front perspective of the inner liner shown in FIGS. 16 and 18.
Figure 20:
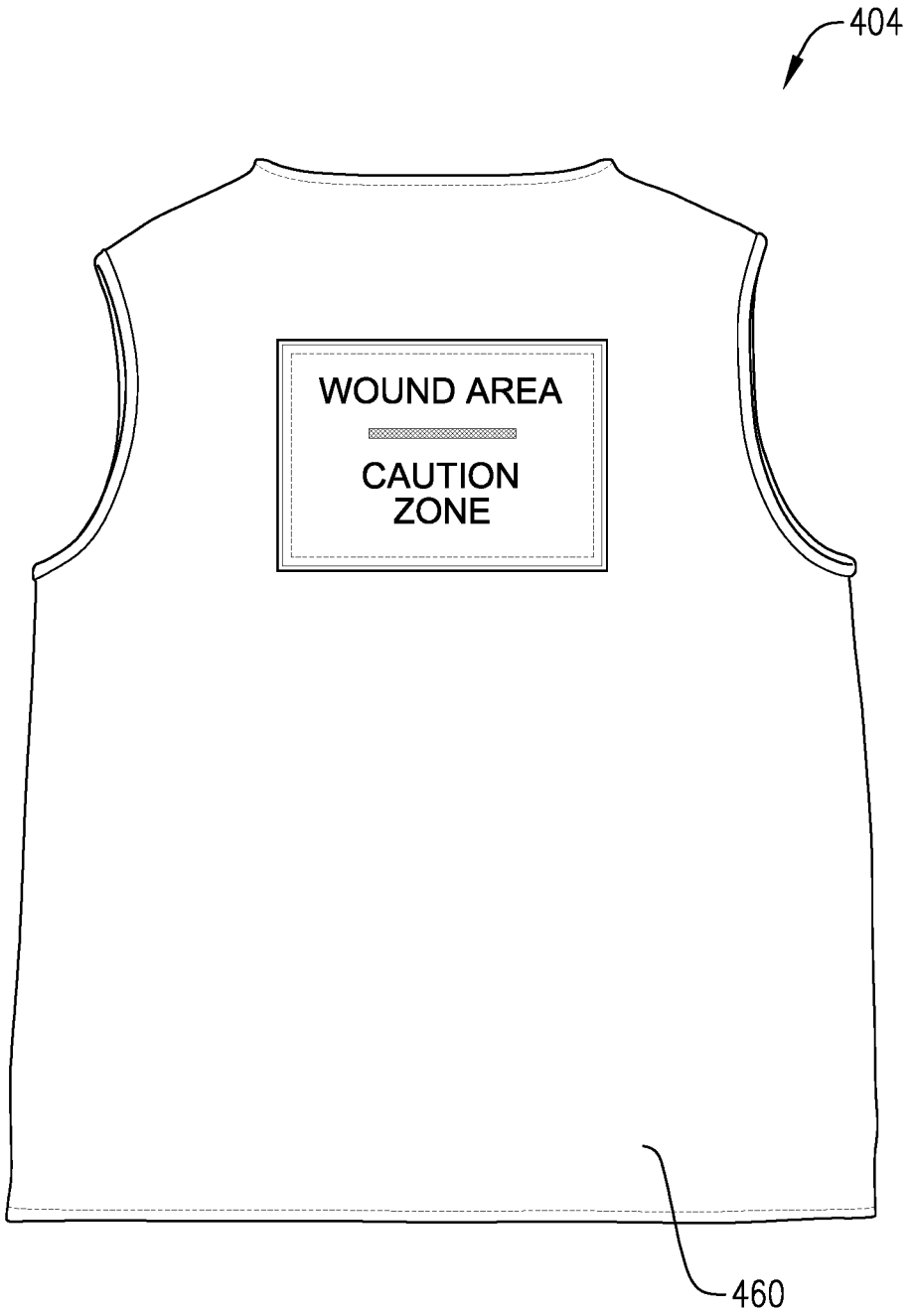
FIG. 20 is a rear elevation of the inner liner shown in FIGS. 16, 18, and 19.

The liner 404 preferably includes front indicia 454 that visibly identify the location of the breast pockets 470 along an exterior surface of the liner 404 (see FIG. 19). The front indicia 454 of the liner 404 are printed onto flexible substrate patches that are sewn onto the outer layer 460. In the illustrated embodiment, the indicia 454 of liner 404 overlie the breast pocket 470.

The shell 402 and the liner 404 each include mating zipper fasteners 471 to removably attach the shell 402 and liner 404 to one another (see FIG. 16). However, it will be appreciated that alternative removable fasteners, such as buttons, snaps, or hook-and-loop material, could be used in place of the zippers.

The fasteners 471 can be detached from one another to remove and separate the liner 404 from the shell 402. For instance, it will be appreciated that the shell 402 could be donned by itself. That is, the shell 402 could be detached from the liner 404 and donned without donning the liner 404. In such an instance, one or more of the breast pads 468 could be selectively inserted in breast pockets 448.

Similarly, it will also be appreciated that the liner 404 could be donned by itself while being detached from the shell 402. When the liner 404 is donned without the shell 402, the fasteners 471 of the liner 404 are removably attachable to one another (see FIG. 19) to secure the liner 404 on the user.

Turning to FIG. 16, the illustrated fluid transfer assembly 406 is configured to collect fluid from a surgical site (not shown) of a mastectomy patient. In particular, the fluid transfer assembly 406 preferably comprises a post-operative drain system operable to collect bodily fluid that drains from a single surgical site (associated with a single mastectomy) or two surgical sites (associated with a double mastectomy). The fluid transfer assembly 406 preferably includes a fluid reservoir 472 and fluid transfer tubing 474.

The illustrated fluid reservoir 472 comprises a flexible, sealed container that presents a chamber (not shown) to receive fluid from the patient. During use of the fluid transfer assembly 406, the reservoir 472 is preferably removably inserted and stored in an interior pocket 476 of the liner 404, including when the garment 400 is donned. The reservoir can be selectively removed from the pocket 476 (e.g., to permit disposal or replacement of the reservoir 472).

The illustrated tubing 474 is configured to transfer drained fluid from one or two surgical sites to the fluid reservoir 472. The tubing 474 preferably includes a reservoir connector 478, tubing sections 480*a,b, c*, access connectors 482 that fluidly communicate with tubing sections 480, and a multi-line connector 484 that fluidly connects tubing sections 480*a,b* to tubing section 480*c*. The access connectors 482 are each fluidly connectable to an access site (not shown) associated with a surgical site.

The multi-line connector 484 fluidly connects both tubing sections 480*a,b* to tubing section 480*c*. Tubing section 480*c* is removably connected to the reservoir 472 with the reservoir connector 478. Thus, the tubing 474 is operable to provide continuous fluid paths from each access connector 482 to the reservoir 472.

Again, the fluid transfer assembly 406 is operable to collect fluid from the patient. However, it is within the ambit of the present invention where the fluid transfer assembly 406 is alternatively configured to supply a fluid to the patient. For instance, the fluid transfer assembly 406 could be operable to supply a fluid anesthesia medication to the patient for anesthesia therapy. In such an alternative embodiment, the alternative fluid reservoir could include an anesthesia infusion pump (such as a manually-operated pump) that is operated by a user (such as the patient) to selectively pump anesthesia through fluid tubing to an injection site (not shown) on the patient.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of the present invention as pertains to any apparatus not materially departing from but outside the literal scope of the invention as set forth in the following claims.

What is claimed is:

1. An adaptable protective garment configured to be donned by a user to cover and identify a sensitive portion of the user, said adaptable protective garment comprising:

an outer garment layer extending about a user-occupiable garment interior, with the garment interior presented by the garment configured to receive the user when the garment is donned;

said outer garment layer configured to cover the sensitive portion when the garment is donned, said outer garment layer presenting interior and exterior surfaces, with the exterior surface being viewable when the garment is donned;

an inner pocket layer being fixed relative to the interior surface of the outer garment layer and partly coextensive with the outer garment layer;

an intermediate liner layer fixed between the inner pocket layer and the outer garment layer and at least partly coextensive with the outer garment layer, said inner pocket layer at least partly defining a first interior pocket and separating the first interior pocket from the garment interior, with the first interior pocket being configured to be adjacent the sensitive portion and the user-occupiable garment interior configured to be adjacent to non-sensitive portions of the user when the garment is donned, said intermediate liner layer and said outer garment layer cooperatively defining a second interior pocket, with the interior pockets being covered by the outer garment layer when the garment is donned so as to be hidden from view;

and exposed indicia secured to the exterior surface of the outer garment layer and viewable when the garment is donned, said exposed indicia overlying the interior pockets to visibly identify the location of the interior-pocket interior pockets along the exterior surface.

2. The adaptable protective garment as claimed in claim 1, said intermediate liner layer being substantially coextensive with the outer garment layer, said second interior pocket being elongated to extend vertically along the length of the garment between upper and lower pocket ends.

3. The adaptable protective garment as claimed in claim 2, said intermediate liner layer presenting an access slit that communicates with the second interior pocket and is positioned between the pocket ends.

4. The adaptable protective garment as claimed in claim 3, said outer garment layer and said intermediate liner layer presenting upper and lower garment margins, with the pocket ends being located adjacent the respective upper and lower garment margins.

5. The adaptable protective garment as claimed in claim 3; and a garment pad removably mounted within the second interior pocket, with the access slit permitting insertion and removal of the garment pad relative to the second interior pocket.

6. The adaptable protective garment as claimed in claim 5, said exposed indicia at least partly overlying the garment pad.

7. The adaptable protective garment as claimed in claim 1, said inner garment layer and said intermediate liner layer cooperatively defining the first interior pocket, said inner pocket layer at least partly defining an open pocket top that communicates with the first interior pocket.

8. The adaptable protective garment as claimed in claim 7; and a garment pad removably mounted within the first interior pocket, with the open pocket top permitting insertion and removal of the garment pad relative to the first interior pocket.

9. The adaptable protective garment as claimed in claim 7, said exposed indicia at least partly surrounding the inner pocket layer.

10. The adaptable protective garment as claimed in claim 7, said intermediate liner layer being substantially coextensive with the outer garment layer, said second interior pocket being elongated to extend vertically along the length of the garment between upper and lower pocket ends.

11. The adaptable protective garment as claimed in claim 10, said intermediate liner layer presenting an access slit that communicates with the second interior pocket and is positioned between the pocket ends.

12. The adaptable protective garment as claimed in claim 11; and a garment pad removably mounted within the second interior pocket, with the access slit permitting insertion and removal of the garment pad relative to the second interior pocket.

13. The adaptable protective garment as claimed in claim 11; and a fill layer located between the intermediate liner layer and the outer garment layer, said fill layer being located within the second interior pocket.

14. The adaptable protective garment as claimed in claim 11; and first and second garment pads, said first garment pad being removably mounted within the first interior pocket and said second garment pad being removably mounted within the second interior pocket, said open pocket top permitting insertion and removal of the first garment pad relative to the first interior pocket, said access slit permitting insertion and removal of the second garment pad relative to the second interior pocket.

15. The adaptable protective garment as claimed in claim 14, said exposed indicia at least partly overlying both of the garment pads.

16. The adaptable protective garment as claimed in claim 1, said intermediate liner layer presenting an access slit that communicates with the second interior pocket and permits access thereto; and a garment pad removably mounted within the second interior pocket, with the access slit permitting insertion and removal of the garment pad relative to the second interior pocket, said exposed indicia at least partly overlying the garment pad.

17. The adaptable protective garment as claimed in claim 1; and a fluid transfer assembly supported relative to and covered by the outer garment layer when the garment is donned so as to be hidden from view, said fluid transfer assembly including a fluid reservoir, with fluid transfer assembly configured to transfer fluid between the fluid reservoir and the user.

18. The adaptable protective garment as claimed in claim 17, said exposed indicia being located adjacent the fluid reservoir to visibly identify the location of the fluid reservoir along the exterior surface.

19. The adaptable protective garment as claimed in claim 1; and a garment pad mounted within one of the interior pockets, at least one of said layers including a stretchable material that permits circumferential expansion and contraction of the garment while restricting said one interior pocket from moving circumferentially.

20. The adaptable protective garment as claimed in claim 19, said at least one of the layers including a first panel that at least partly defines the one interior pocket and a second panel that extends circumferentially from the first panel and includes the stretchable material.

* * * * *